US011694663B2

(12) United States Patent
Yokota

(10) Patent No.: US 11,694,663 B2
(45) **Date of Patent: *Jul. 4, 2023**

(54) EFFECT ADDITION DEVICE, EFFECT ADDITION METHOD AND STORAGE MEDIUM

(71) Applicant: CASIO COMPUTER CO., LTD., Tokyo (JP)

(72) Inventor: Masuo Yokota, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 206 days.

This patent is subject to a terminal disclaimer.

(21) Appl. No.: 17/191,286

(22) Filed: Mar. 3, 2021

(65) Prior Publication Data

US 2021/0304713 A1 Sep. 30, 2021

(30) Foreign Application Priority Data

Mar. 25, 2020 (JP) ..... 2020-055081

(51) Int. Cl.
*G10H 1/00* (2006.01)
*G10K 15/08* (2006.01)

(52) U.S. Cl.
CPC ..... *G10H 1/0091* (2013.01); *G10K 15/08* (2013.01); *G10H 2250/105* (2013.01); *G10H 2250/115* (2013.01)

(58) Field of Classification Search
CPC ..... G10H 1/0091; G10H 2250/105; G10H 2250/115; G10K 15/08
(Continued)

(56) References Cited

U.S. PATENT DOCUMENTS 10,339,907 B2 7/2019 Yokota
2003/0169887 A1* 9/2003 Fujita ..... G10H 1/0091 381/63
2018/0182364 A1 6/2018 Sakata

FOREIGN PATENT DOCUMENTS

JP 2003280675 A 10/2003
JP 2005215058 A 8/2005
(Continued)

OTHER PUBLICATIONS

Japanese Office Action (and English language translation thereof) dated Feb. 1, 2022, issued in Japanese Application No. 2020-055081.

*Primary Examiner* — Vivian C Chin
*Assistant Examiner* — Douglas J Suthers
(74) *Attorney, Agent, or Firm* — Holtz, Holtz & Volek PC

(57) ABSTRACT

An effect addition device includes at least one processor that executes a time domain convolution process of convolving a first time domain data part of impulse response of sound effects with a time domain data on an original sound, a frequency domain convolution process of convoluting a second time domain data part of the impulse response data with the time domain data on the original sound, a convolution extension process of extending a convolved state(s) of an output signal(s) resulting from the time domain convolution process and/or the frequency domain convolution process by arithmetic processing which corresponds to an all-pass filter and/or arithmetic processing which corresponds to a comb filter, and a synthesized sound effect addition process of adding a sound effect which is synthesized by execution of the time domain convolution process, the frequency domain convolution process and the convolution extension process to the original sound.

14 Claims, 15 Drawing Sheets

(58) Field of Classification Search
USPC ..... 381/63
See application file for complete search history.

(56) References Cited

FOREIGN PATENT DOCUMENTS

| | | | |
|---|---|---|---|
| JP | 2005266681 | A | 9/2005 |
| JP | 2018106006 | A | 7/2018 |
| JP | 2018151589 | A | 9/2018 |

* cited by examiner

FIG. 14

| CONVOLUTION TABLE 1401 | | APPLICATION | | | |
|---|---|---|---|---|---|
| | | REVERBERATION | | | RESONANCE (PEDAL) |
| | | SHORT | MEDIUM | LONG | PARAMETER DYNAMIC OPERATION |
| | | FIR+CONV | FIR+CONV +CONVOLUTION EXTENSION UNIT | FIR+CONV1+CONV2 +CONVOLUTION EXTENSION UNIT | FIR + CONV +CONVOLUTION EXTENSION UNIT |
| CONVOLUTION TABLE | IMPULSE RESPONSE DATA | ROOM | FOR MEDIUM HALL | LARGE HALL | RESONANCE |
| | CONFIGURATION INFORMATION ON EFFECT ADDITION DEVICE | | | | |
| | BLOCK SIZE INFORMATION | | | | |
| | NUMBER OF SAMPLES OF N | 512 | 512 | 512 | 512 |
| | CONVOLUTION EXECUTION UNIT SETTING INFORMATION | | | | |
| | NUMBER OF CONVS | 1 | 1 | 2 | 1 |
| | NUMBER OF CONV1 PROCESSED BLOCKS | 100(C3～C102) | 150(C3～C152) | 2(C3～C4) | 50(C3～C52) |
| | CONV1 SAMPLING RATE | fs | fs | fs | fs |
| | NUMBER OF CONV2 PROCESSED BLOCKS | NO DATA | NO DATA | 100(N5～N254) | NO DATA |
| | CONV2 SAMPLING RATE | NO DATA | NO DATA | fs | NO DATA |
| | · | | | | |
| | · | | | | |
| | CONVOLUTION EXTENSION UNIT SETTING INFORMATION | | | | |
| | Comb SETTING | NO | FOR MEDIUM HALL | FOR LARGE HALL | FOR RESONANCE |
| | APF SETTING | NO | | | |
| | MULTIPLIER 309 LEVEL VALUE | 0% | 60% | 10% | 50% |
| | MULTIPLIER 310 LEVEL VALUE | 0% | 40% | 30% | 50% |
| | MULTIPLIER 1002 LEVEL VALUE | 0% | 0% | 60% | 0% |
| | · | | | | |
| | · | | | | |
| | MULTIPLIER 312 LEVEL VALUE | 0% | 0% | 100% | OPERATOR SET VALUE |

EFFECT ADDITION DEVICE, EFFECT ADDITION METHOD AND STORAGE MEDIUM

BACKGROUND OF THE INVENTION

1. Field of the Invention

The present invention relates to an effect addition device, an effect addition method and a storage medium which are used for adding a sound effect to an original sound by convolving impulse response of sound effects with the original sound.

2. Description of the Related Art

In a reverberation addition device which adds a reverberation effect and a resonance effect by convolving the impulse response data with a direct sound of an audio signal, a technology (for example, Japanese Patent Application Laid-Open No. 2003-280675) which uses an FIR (Finite Impulse Response) filter which performs convolution in a time domain and a technology (for example, Japanese Patent Application Laid-Open No. 2005-215058) which uses an FFT/iFFT (Fast Fourier Transform/inverse FFT) which performs the convolution in a frequency domain are known as technologies for use in a convolution unit which is used in this reverberation addition device.

In addition, there is also known a reverberation addition device (for example, Japanese Patent Application Laid-Open No. 2005-266681) which includes first and second convolution arithmetic operation units for use in time domain convolution, a comb filter unit and an all-pass filter unit.

BRIEF SUMMARY OF THE INVENTION

According to one aspect of the present invention, there is provided an effect addition device which includes at least one processor, in which the processor executes a time domain convolution process of convolving a first time domain data part of impulse response of sound effects with a time domain data on an original sound by time domain FIR (Finite Impulse Response) arithmetic processing which is executed in units of sampling periods, a frequency domain convolution process of convoluting a second time domain data part of the impulse response data with the time domain data on the original sound by frequency domain arithmetic processing using a fast Fourier transform arithmetic operation in units of blocks of a predetermined time length respectively, a convolution extension process of extending a convolved state or states of an output signal or signals which is/are output as a result of execution of either the time domain convolution process or the frequency domain convolution process or both of the time domain convolution process and the frequency domain convolution process at least by either one type of arithmetic processing which corresponds to an all-pass filter or arithmetic processing which corresponds to a comb filter or both types of the arithmetic processing in a time range which exceeds a time width of the impulse response data, and a synthesized sound effect addition process of adding a sound effect which is synthesized by execution of the time domain convolution process, the frequency domain convolution process and the convolution extension process to the original sound.

BRIEF DESCRIPTION OF THE SEVERAL VIEWS OF THE DRAWINGS

FIG. 14 is a diagram illustrating one configuration example of a convolution table.

DETAILED DESCRIPTION OF THE INVENTION

In the following, a form for embodying the present invention will be described in detail with reference to the drawings. A reverberation-resonance unit which is used as an effect addition device of an electronic musical instrument in an embodiment of the present invention is capable of executing an FIR filter arithmetic processing that a filtration degree is made flexibly variable and makes it possible to simultaneously execute a plurality of types of FIR filter arithmetic processing which are mutually different in filtration degree and impulse response characteristic while flexibly changing a combination of the plurality of types of FIR filter arithmetic processing. A time domain convolution process by such a plurality of types of FIR filter arithmetic processing as described above, a frequency domain convolution process which uses an FFT arithmetic operation and, further, convolution extension processes are combined with one another and are implemented into the effect addition device in one embodiment. In this case, since it becomes possible to flexibly decide the number of FFTs used for the frequency domain convolution process and the filtration degree of FIR filter arithmetic processing, it becomes possible to add highly reproducible reverberation effect-resonance effect to a musical sound of the electronic musical instrument with no sacrifice of responsiveness. In addition, in the frequency domain convolution process, since it is possible to connect a plurality of stages of blocks of different sizes, it becomes possible to set an optimum configuration in accordance with characteristics of impulse response.

Figure 1:
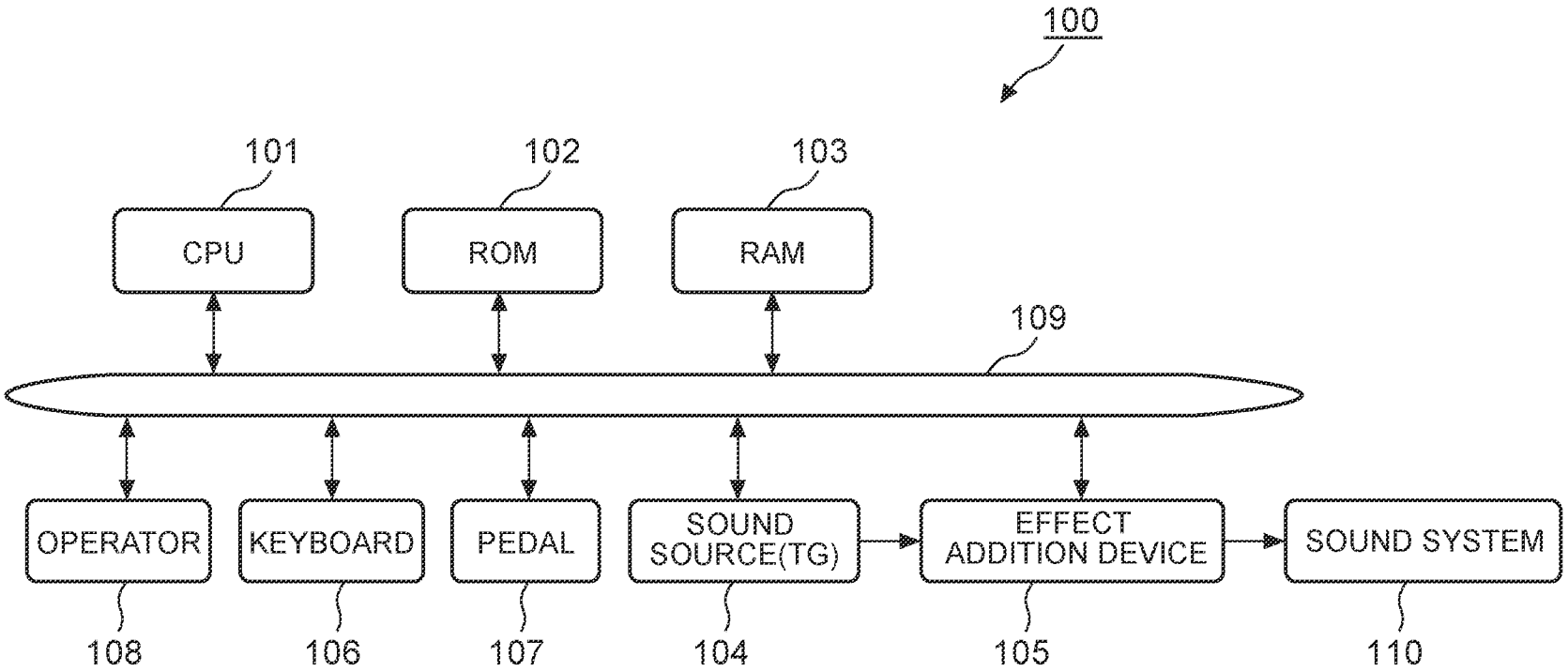
FIG. 1 is a block diagram illustrating one example of an electronic musical instrument which includes an effect addition device according to one embodiment of the present invention.

FIG. 1 is a block diagram illustrating one example of an electronic musical instrument 100 which includes an effect addition device according to one embodiment of the present invention. The electronic musical instrument 100 has a configuration that a CPU (Central Processing Unit) 101, a ROM (Read Only Memory) 102, a RAM (Random Access Memory) 103, a sound source (TG: Tone Generator) 104, an effect addition device 105 (a synthesized sound effect addition device), a keyboard 106, a pedal 107 and an operator 108 are connected to a system bus 109. In addition, an output terminal of the sound source (TG) 104 is connected to a sound system 110 via the effect addition device 105.

The CPU 101 executes a control program which is loaded from the ROM 102 to the RAM 103 and thereby issues an instruction to emit a sound to the sound source 104 on the basis of musical performance operation information from the keyboard 106 and the operator 108.

The sound source (TG) 104 reads waveform data out of the ROM 102 or the RAM 103 in accordance with the above-described instruction to emit the sound and thereby generates musical sound data. The musical sound data is output to the sound system 110 via the effect addition device 105. At this time, for example, in a case where the pedal 107 is stepped on, the effect addition device 105 executes an effect addition process such as addition of a reverberant sound such as reverb and so forth, addition of a resonance sound of piano strings and so forth on the musical sound data. As a result, the musical sound data which is output from the effect addition device 105 is converted to an analog musical sound signal by a digital-to-analog converter, is amplified by an analog amplifier and is emitted from a loudspeaker in the sound system 110.

Figure 2:
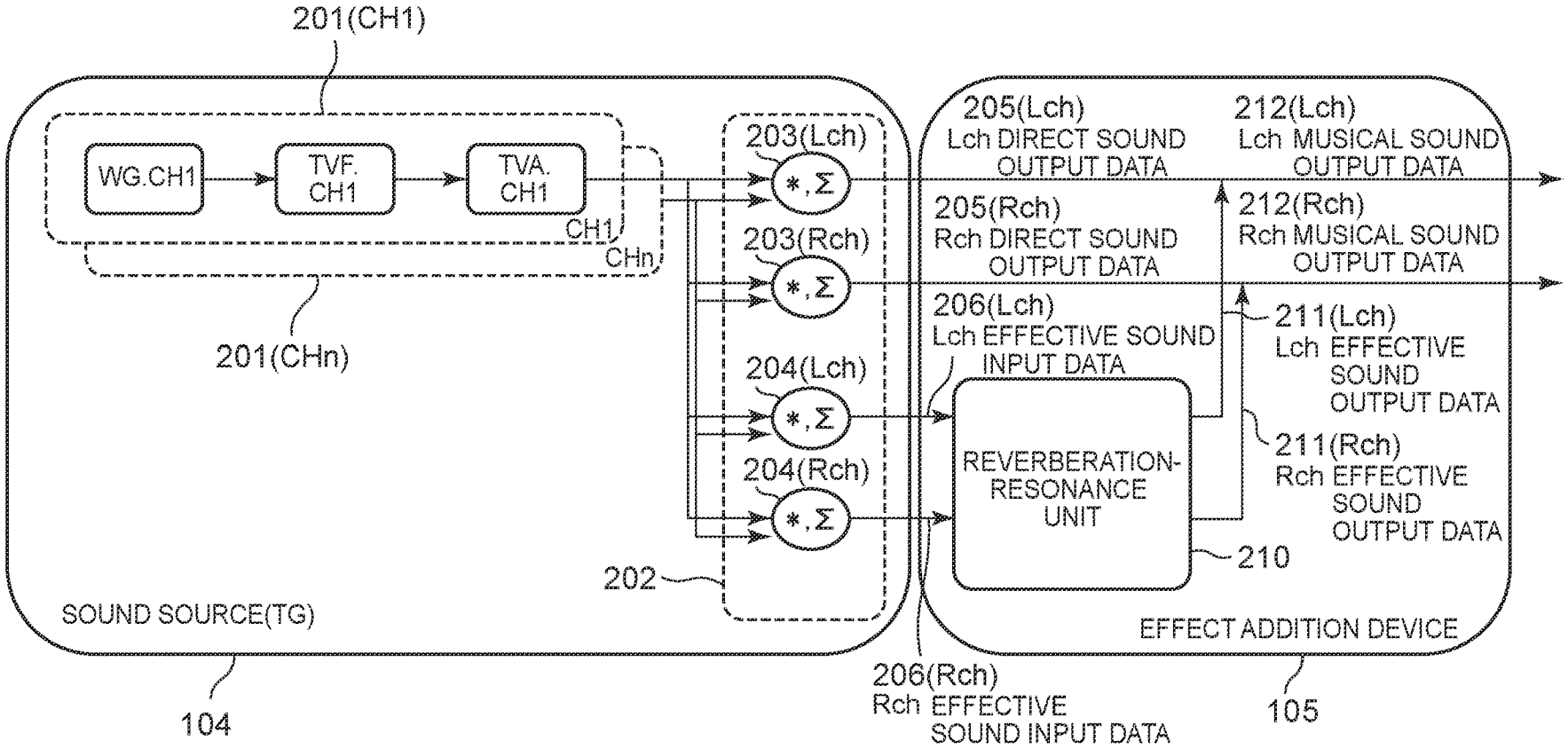
FIG. 2 is a block diagram illustrating one example of a sound source (TG) and the effect addition device.

FIG. 2 is a block diagram illustrating one example of the sound source (TG) 104 and the effect addition device 105 and illustrates one example of a flow of the musical sound data in the electronic musical instrument 100 which has the configuration which is illustrated in FIG. 1. The sound source (TG) 104 includes musical sound generation units 201(CH1) to 201 (CHn) which generate the musical sound data via sound emission channels, such as, n channels from a channel CH1 to a channel CHn and these musical sound generation units 201 generate independent musical sound data every time a key is pressed respectively in accordance with a sound emission instruction which is generated from the CPU 101 in FIG. 1 on the basis of pressing of keys on the keyboard 106. The musical sound generation unit 201 (Chi) ($1 \leq i \leq n$) which corresponds to the sound emission channel CHi includes a waveform generation section WG. CHi which generates waveform data, a filter processing section TVF. CHi which processes the tone of the generated waveform data and an amplitude envelope processing section TVA. CHi which processes an amplitude envelope of the generated waveform data.

Each of four mixers 203 (Lch), 203 (Rch), 204 (Lch) and 204 (Rch) in a mixing unit 202 multiplies each piece of musical sound data that each musical sound generation unit 201 (CHi) (1*n*) outputs by a predetermined level and accumulates results of multiplication and thereby outputs each of Lch (left channel) direct sound output data 205 (Lch), Rch (right channel) direct sound output data 205 (Rch), Lch effective sound input data 206 (Lch) and Rch effective sound input data 206 (Rch) to the effect addition device 105. Incidentally, in FIG. 2, marks "*, Σ" in each of the mixers 203 (Lch), 203 (Rch), 204 (Lch) and 204 (Rch) indicate to multiply each pieces of the input data by the predetermined level, to accumulate the respective results of multiplication and to output the result of accumulation.

Reverberation and resonance effects are added to each of Lch effective sound input data 206 (Lch) and Rch effective sound input data 206 (Rch) in a reverberation-resonance unit 210 in the effect addition device 105 and the Lch effective sound input data 206 (Lch) and Rch effective sound input data 206 (Rch) are output as Lch effective sound output data 211 (Lch) and Rch effective sound output data 211 (Rch). The Lch effective sound output data 211 (Lch) is added with the Lch direct sound output data 205 (Lch) in the effect addition device 105 and is output to the sound system 110 in FIG. 1 as Lch musical sound output data 212 (Lch). Likewise, the Rch effective sound output data 211 (Rch) is added with the Rch direct sound output data 205 (Rch) in the effect addition device 105 and is output to the sound system 110 as Rch musical sound output data 212 (Rch). In the sound system 110, the Lch musical sound output data 212 (Lch) and the Rch musical sound output data 212 (Rch) are converted to an Lch analog musical sound signal and an Rch analog musical sound signal respectively, are amplified by analog amplifiers respectively and are emitted from Lch and Rch loud speakers respectively.

Figure 3A:
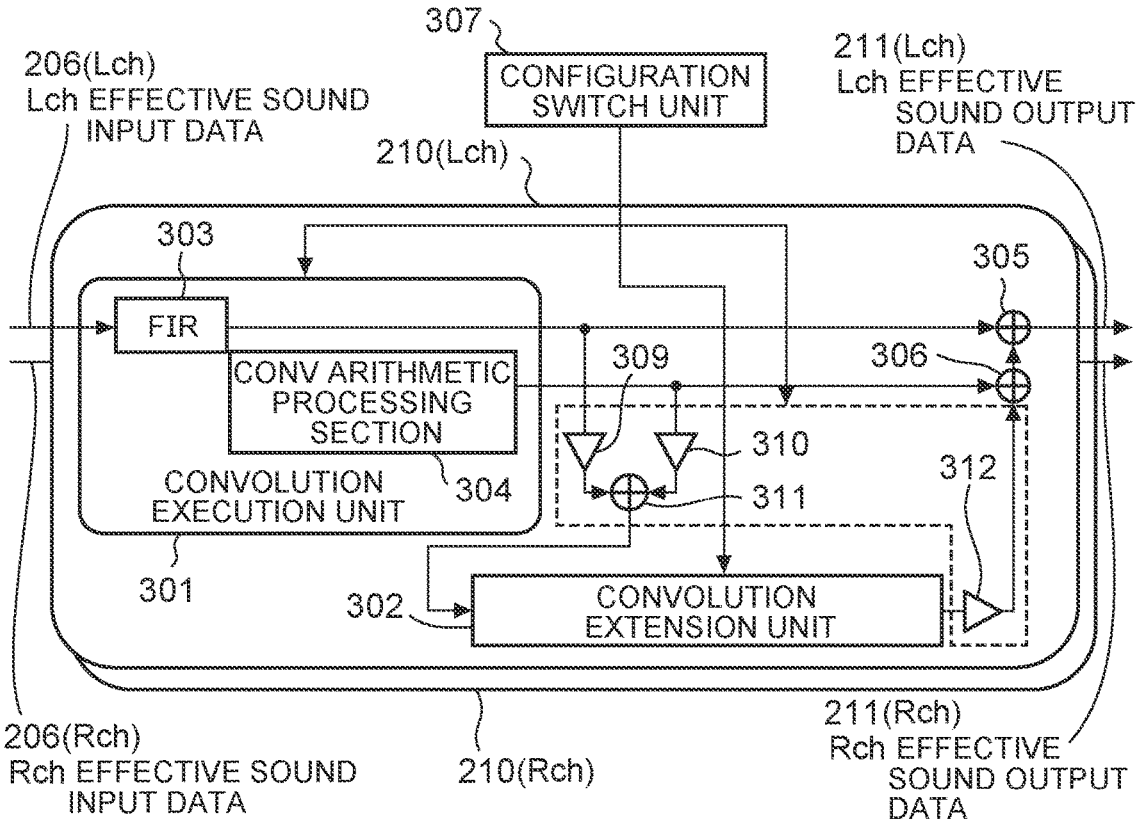
FIG. 3A is a block diagram illustrating one example of a reverberation-resonance unit of the effect addition device according to one embodiment of the present invention.

FIG. 3A is a block diagram illustrating one example of the reverberation-resonance unit 210 in the effect addition device 105 in FIG. 2. The reverberation-resonance unit 210 is configured by a reverberation-resonance unite 210 (Lch) and a reverberation-resonance unit 210 (Rch). The reverberation-resonance unit 210 (Lch) inputs therein the Lch effective sound output data 206 (Lch), adds an Lch reverberation-resonance effect to the data 206 (Lch) and outputs the Lch effective sound output data 211 (Lch). The reverberation-resonance unit 210 (Rch) inputs therein the Rch effective sound output data 206 (Rch), adds an Rch reverberation-resonance effect to the data 206 (Rch) and outputs the Rch effective sound output data 211 (Rch). Since the both devices have the same configuration, in the following, description will be made with no distinction between Lch and Rch unless otherwise specified.

The Lch effective sound input data 206 (Lch) or the Rch effective sound input data 206 (Rch) which is input into the reverberation-resonance unit 210 is input into a convolution execution unit which includes an FIR filter arithmetic processing section 303 and a CONV arithmetic processing section 304 in parallel. The convolution execution unit 301 executes a process of convoluting impulse response data of an effective sound on the input data 206 (Lch) and 206 (Rch).

The FIR filter arithmetic processing section 303 which is disposed in the convolution execution unit 301 is a time domain convolution section which convolutes the front-half data part of the reverberation-resonance impulse response data directly with the Lch effective sound input data 206 (Lch) or the Rch effective sound input data 206 (Rch) (the original sound) in a time domain by time domain processing which is executed in units of sampling periods. In this case, the FIR filter arithmetic processing section 303 defines the predetermined number N of samples which are contiguously arranged in the time domain as one block and executes a direct convolution process on 2N samples (which is two times as many as N (block size). The predetermined number N is, for example, 512 samples (see FIG. 15). The reason why the number of the convolution processes is 2N will be described later.

The CONV arithmetic processing section 304 which is disposed in the convolution execution unit 301 is a frequency domain convolution section which convolves data on the 2N samples in total that N zeros are added to data on N samples in block size which is the rear-half data part of the above-described impulse response data with the Lch effective sound input data 206 (Lch) or the Rch effective sound input data 206 (Rch) (the original sound) which is cut out also in units of 2N (samples) which is two times as many as the block size (N) by using an FFT (Fast Fourier Transform) arithmetic operation that the number of arithmetic operations is 2N points which is two times as many as the block size. This convolution process may be executed by using, for example, an OverLap-Add method, an OverLap-Save method.

The FIR filer arithmetic processing section 303 and the CONV arithmetic processing section 304 execute the arithmetic processing while using the RAM which is implemented in DSP (Digital Signal Processor) which is the effect addition device 105 in FIG. 2 as a common area. Outputs from the FIR filter arithmetic processing section 303 and the CONV arithmetic processing section 304 are added together via addition units 305 and 306 respectively and are output as the Lch effective sound output data 211 (Lch) or the Rch effective sound output data 211 (Rch).

In addition, the outputs from the FIR filter arithmetic processing section 303 and the CONV arithmetic processing section 304 are multiplied by respective level values which are set from a configuration switch unit 307 which will be described later) by multiplies 309 and 310 and then respective multiplied results are added together by an adder 311 and a result of addition is input into a convolution extension unit 302.

The convolution extension unit 302 generates convolution extension signal data. The convolution extension signal data is effective sound signal data which is generated in a time range which exceeds a time width of the impulse response data that the convolution execution unit 301 is capable of processing.

Figure 3B:
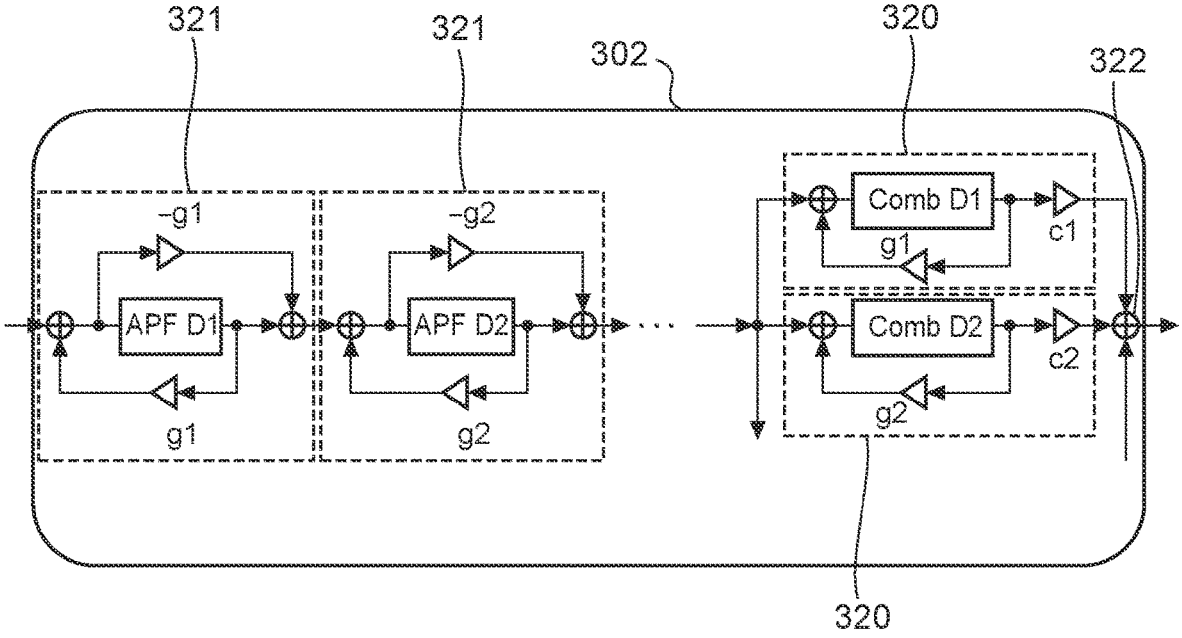
FIG. 3B is a block diagram illustrating one detailed example of a convolution extension unit 302.

FIG. 3B is a block diagram illustrating one detailed configuration example of the convolution extension unit 302 in FIG. 3A. In one embodiment, the convolution extension unit 302 is configured by a plurality of series-connected all-pass filters 321 (one broken-line part in FIG. 3B) and a plurality of parallel-connected comb filters 320(another broken line part in FIG. 3B) so as to avoid awkwardness of a connection part between an output from the convolution execution unit 301 and a convolution extension signal and in view of easiness in parameter operations. Delay times and coefficients of the all-pass filters 321 and the comb filters 320 are set by the configuration switch unit 307 which will be described later.

Although not illustrated in FIG. 3B, a filter which is adapted to adjust a feedback component from the output side to the input side may be installed for each comb filter 320.

The respective all-pass filters 321 are configured as all-pass filters which are respectively equipped with feedback loops (g1, g2 and so forth in FIG. 3B) and feedforward loops (−g1, −g2 and so forth in FIG. 3B) which have delay circuits (APF D1, APF D2 and so forth in FIG. 3B) and extend from the output side to the input side. Each all-pass filter 321 is a filter which is adapted to scatter a convolution input signal data which is input from the convolution execution unit 301 in a time direction. The respective comb filters 320 are configured as comb filters which are respectively equipped with feedback loops (g1, g2 and so forth in FIG. 3B) which have delay circuits (Comb D1, Comb D2 and so forth in FIG. 3B), filters (for example, shelving filters) and so forth and gain amplifiers (c1, c2 and so forth in FIG. 3B). Each comb filter 320 is a filter which has a comb-tooth shaped notch characteristic as a frequency characteristic. The comb filter 321 generates a decay signal which gradually decays in amplitude by making the convolution input signal data which is input from the convolution execution unit 301 repetitively circulate in the feedback loop relative to the signal data which is scattered by the all-pass filter 321.

Outputs from the series-connected all-pass filters 321 are input into the plurality of parallel-connected comb filters 320 and then outputs from the plurality of comb filters 320 are added together by an adder 322 and a result of addition of the outputs is output as convolution extension signal data from the convolution extension unit 302. In FIG. 3A, the convolution extension signal data is multiplied by a level value which is set from the configuration switch unit 307 which will be described later by a multiplier 312 and then is added with respective outputs from the FIR filter arithmetic processing section 303 and the CONV arithmetic processing section 304 via the adders 305 and 306 respectively and a result of addition is output as the Lch effective sound output data 211 (Lch) or the Rch effective sound output data 211 (Rch).

Figure 4:
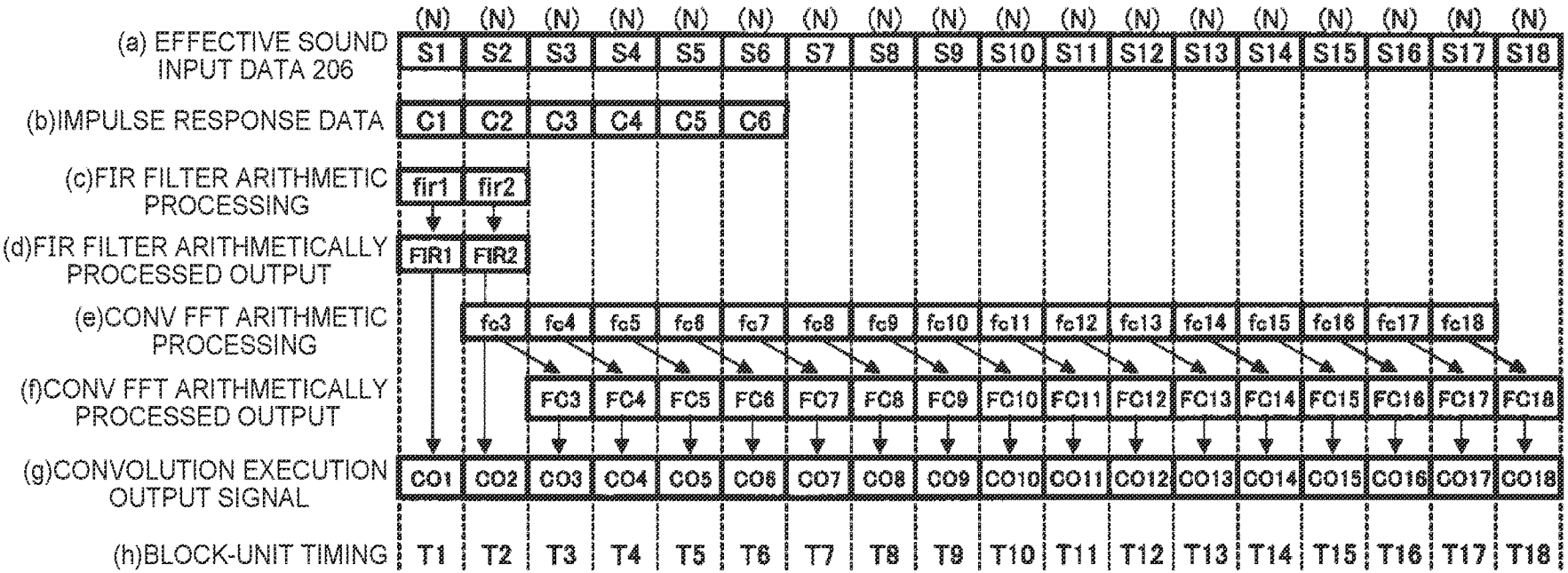
FIG. 4 is an explanatory diagram illustrating one example of a relation between an FIR filter arithmetic processing unit and a CONV (convolution) arithmetic processing unit in the reverberation-resonance unit of the effect addition device according to one embodiment of the present invention.

FIG. 4 is an explanatory diagram illustrating one example of a timing relation between the FIR filter arithmetic processing section 303 and the CONV arithmetic processing section 304 of the reverberation-resonance unit 210 in one embodiment which is described with reference to FIG. 3A.

In a linear convolution arithmetic operation which uses the FFT arithmetic operation in the CONV arithmetic processing section 304, calculations are executed, for example, in units of N samples (N is one block size). For example, at a block timing T1 in (h) in FIG. 4, N-based input data S1 (N pieces of input data S1 on N samples in total) is sequentially input into the reverberation-resonance unit 210 sample by sample in synchronization with the sampling period and buffered into a memory as the effective sound input data 206 (Lch) in (a) in FIG. 4 (the Lch effective sound input data 206 (Lch) or the Rch effective sound input data 206 (Rch) in FIG. 2. The same hereinafter). On the other hand, as indicated in (e) and (h) in FIG. 4, at the next block timing T2, an FFT/iFFT arithmetic operation is executed by the CONV arithmetic processing section 304 targeting at the N-based input data S1 which is input and buffered into the memory at the block timing T1. Incidentally, in (e) in FIG. 4, a series of arithmetic operations which include the FFT arithmetic operation and the iFFT arithmetic operation are abbreviated as "CONV FFT arithmetic processing". Further, in (e) in FIG. 4, the CONV FFT arithmetic processing which is executed block by block is denoted as "fc3" and so forth. That is, it is supposed that "fc" means the CONV FFT arithmetic processing. Details of the CONV FFT arithmetic processing will be described later with reference to FIG. 7 to FIG. 9. In addition, at the block timing T2, N-based input data S2 is sequentially input sample by sample in synchronization with the sampling period and buffered into the memory as the next effective sound input data 206 (Lch). Further, as indicted in (f) and (h) in FIG. 4, at the block timing T3 which comes after the block timing T2, N-based CONV FFT arithmetically processed output data FC3 which is output and buffered into the memory as a result of execution of the CONV FFT arithmetic processing fc3 at the block timing T2 is sequentially output sample by sample in synchronization with the sampling period. In addition, at the block timing T3, CONV FFT arithmetic processing fc4 is executed targeting at the N-based input data S2 which is input and buffered into the memory at the block timing T2. In addition, N-based input data S3 is sequentially input sample by sample in synchronization with the sampling period and buffered into the memory as the third block effective sound input data 206 (Lch). N-based CONV FFT arithmetically processed output data FC4 which is output and buffered into the memory as a result of execution of the CONV FFT arithmetic processing fc4 is output at a block timing 14. In the following, CONV FFT arithmetic processing fc5 and succeeding processing are executed in the same manner.

As just described, in the CONV FFT arithmetic processing which is executed by the CONV arithmetic processing section 304, a processing delay of the amount which corresponds to 2 blocks (=2N samples) occurs in a time from when N-based input data Si (i=1, 2, 3, . . . ) which is indicated in (a) in FIG. 4 is input (buffered) to when CONV FFT arithmetically processed output data FCi (i=3, 4, 5, . . . ) which is indicated in (f) in FIG. 4 is output. On the other hand, in the FIR filter arithmetic processing section 303, as will be described later with reference to FIG. 5, for example, at the block timing T1 in (h) in FIG. 4, in a case where the N-based input data S1 is sequentially input sample by sample into the FIR filter arithmetic processing section 303 in synchronization with the sampling period as the effective sound input data 206 (Lch), FIR filter arithmetic processing (denoted as "fir 1" in (c) in FIG. 4. It is supposed that "fir" means the FIR filter arithmetic processing) which is indicated in (d) in FIG. 4 is executed and a result of execution of the arithmetic processing (denoted as "FIR 1" in (d) in FIG. 4) is output at once in real time which synchronizes with the sampling period in a duration of the same block timing T1.

Accordingly, in the reverberation-resonance unit 210 in FIG. 3A, the FIR filter arithmetic processing section 303 which executes the FIR filter arithmetic processing (the filtration degree=2N) on the 2N-based input data S1 and S2 which are input at the timings T1 and T2 which come first as the effective sound input data 206 (Lch) is implemented in order to cover the 2N processing delay which occurs in execution of the CONV FFT arithmetic processing by the CONV arithmetic processing section 304.

As a result, the effective sound input data is input into the CONV arithmetic processing section 304 while being shifted N by N simultaneously with inputting of the first 2N samples of the effective sound input data 206 (Lch) into the FIR filter arithmetic processing section 303.

Then, first, as indicated in (a), (b), (c), (d), (g) and (h) in FIG. 4, the FIR filter arithmetic processing (in (c) in FIG. 4, denoted as "fir1" and "fir2". It is supposed that "fir" means the FIR filter arithmetic processing) is executed on the data S1 and S2 in the first two blocks (2N samples) of the effective sound input data 206 (the Lch effective sound input data 206 (Lch) or the Rch effective sound input data 206*b* (Rch) in FIG. 3) and is executed, in every sampling period, on the data C1 and C2 in the first two blocks of the impulse response data on the reverberation sound or the resonance sound in real time by the FIR filter arithmetic processing section 303 in a duration between the block timings T1 and T2. As a result, respective pieces of FIR filter arithmetically processed output data FIR1 and FIR2 are output in real time at the block timings T1 and T2 respectively.

In addition, as indicated in (a), (b), (e), (f), (g) and (h) in FIG. 4, pieces of N-based CONV FFT arithmetically processed output data FC3 and FC4 ((f) in FIG. 4) which are obtained by executing the CONV FFT arithmetic processing on the data blocks S1, S2, . . . of the input data which are input while overlapping with each other block by block (N samples) as the effective sound input data 206 and on data blocks C3, C4, . . . of the impulse response data of the reverberation sound or the resonance sound by the CONV arithmetic processing section 304 are sequentially output in a state of being delayed in units of 2N samples and these pieces of output data are output as convolution execution output signal data CO3, CO4, . . . ((g) in FIG. 4) as they are.

Accordingly, first pieces of 2N-based FIR filter arithmetically processed output data FIR 1 and FIR 2 ((d) in FIG. 4) which are output from the FIR filter arithmetic processing section 303 are output from the addition unit 305 in FIG. 3 as convolution executed output data CO1 and CO2 ((h) in FIG. 4) in the duration between the first block timings T1 and T2. Pieces of N-based CONV FFT arithmetically processed output data FC3, FC4, . . . ((f) in FIG. 4) which are sequentially output from the CONV arithmetic processing section 304 are output as the convolution executed output data CO3, CO4, . . . ((h) in FIG. 4) at a block timing T3 and succeeding block timings T4, . . . which come after the timings 1 and 2. As a result, it becomes possible to output the Lch effective sound output data 211 (Lch) or the Rch effective sound output data 211 (Rch) which is obtained as a result of execution of convolution arithmetic operation on the respective data blocks C1, C2, . . . of the impulse response data from the reverberation-resonance unit 210 in FIG. 3 with no delay relative to the respective data blocks S1, S2, . . . of the Lch effective sound input data 206 (Lch) or the Rch effective sound input data 206 (Rch).

Figure 5:
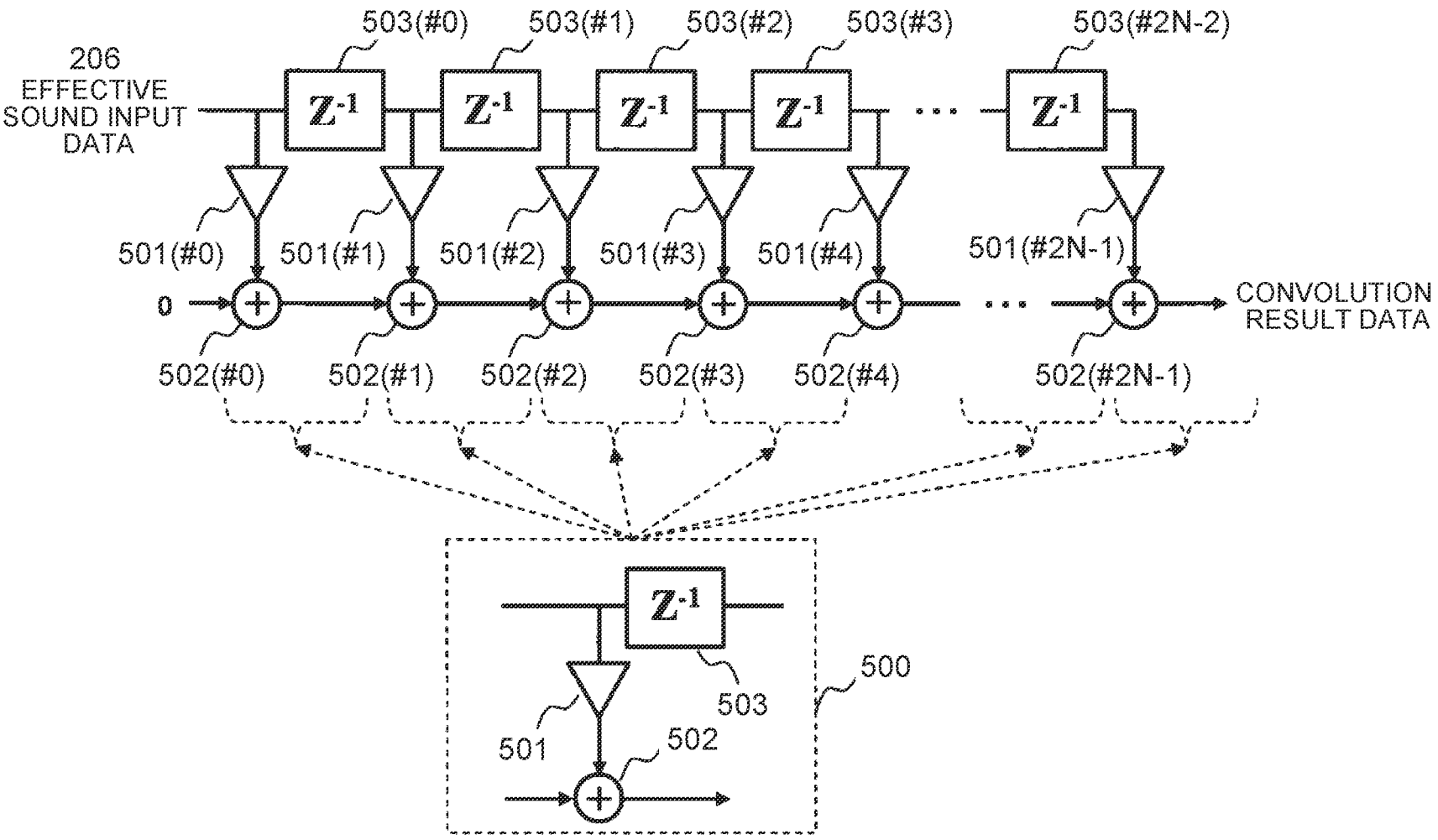
FIG. 5 is a block diagram illustrating one functional configuration example of the FIR filter arithmetic processing unit.

FIG. 5 is a block diagram illustrating one functional configuration example of the FIR filter arithmetic processing section 303 in FIG. 3. FIG. 5 illustrates an FIR filter of a direct-type configuration which is 2N in filtration degree and that primary filter arithmetic operation units 500 each of which is configured by a multiplication processing section 501, an accumulation processing section 502 and a delay processing section 503 are cascade-connected from #0 to #2N−1. However, installation of the delay processing section 503 is not needed at the final stage #2N−1.

Specifically, the effective sound input data 206 (the Lch effective sound input data 206 (Lch) or the Rch effective sound input data 206 (Rch) in FIG. 3) is multiplied by zero-order FIR coefficient data by a zero-order multiplication processing section 501 (#0), multiplication result data thereof is accumulated to the previous-stage accumulation result data (zero-value data because there is no stage in front of the zero-order stage) by a zero-order accumulation processing section 502 (#0). In addition, the effective sound input data is delayed by the amount of one sampling period by the zero-order delay processing section 503 (#0).

Next, output from the zero-order delay processing section 503 (#0) is multiplied by first order FIR coefficient data by the first-order multiplication processing section 501 (#1) and multiplication result data thereof is accumulated by the first-order accumulation processing section 502 (#1) to accumulation result data of the zero-order multiplication processing section 502 (#0) which is located at the preceding stage. In addition, output data from the zero-order delay processing section 503 (#0) is delayed by the amount of one sampling period by the first-order delay processing section 503 (#1).

In the following, FIR arithmetic processing in respective orders is executed sequentially from the 0-order processing to the 2N−1-order processing in the same manner as the above. In general, output data (the effective sound input data when i=0) from the i-order (0≤i≤2N−1) FIR arithmetic processing delay processing section 503 (#i−1) is multiplied by the i-order FIR coefficient data by the i-order multiplication processing section 501 (#i) and multiplication result data thereof is accumulated to the accumulation result data (0-value data when i=0) of the preceding-stage i−1-order accumulation processing section 502 (#i−1) by the i-order accumulation processing section 502 (#i). In addition, output data (the effective sound input data when i=0) from the i−1-order delay processing section 503 (#0) is delayed by the i-order delay processing section 503 (#i) by the amount of one sampling period.

Accumulation result data of the last-stage 2N−i-order accumulation processing section 502 (#2N−1) is output as convolution result data. Incidentally, the last-stage 2N−i-order delay processing section 503 (#2N−1) is not used.

In the FIR filter arithmetic processing section 303 which has the functional configuration which is illustrated in FIG. 5 as described above, it is possible to realize the delay processing sections 503 (#0 to #2N−2) as processing sections which sequentially store the effective sound input data into a ring buffer type memory.

In addition, the effective sound input data signal is input from the mixer 204 (Lch) or the mixer 204 (Rch) in the mixing unit 202 in the sound source (TG) 104 in FIG. 2 into the reverberation-resonance device 210 in units of sampling periods.

The FIR arithmetic processing by the next multiplication processing section 501 and the next accumulation processing section 502 is executed in synchronization with a clock signal which has a period which is obtained by segmenting the sampling period in the sampling period and execution of the FIR arithmetic processing by the multiplication processing sections 501 and the accumulation processing sections 502 in all orders and outputting of the convolution data from the last-stage 2N−1-order accumulation processing section 502 (#2N−1) are completed in that sampling period. Thereby, no delay occurs in the convolution process by the FIR filter arithmetic processing section 303 in FIG. 3.

Although the FIR filter arithmetic processing section 303 executes the process per sampling period, the electronic musical instrument has a plurality of types of reverberation in many cases and the times taken for the impulse response in a case of performing the convolution may become different from one another in various ways depending on the type of the reverberation. In addition, resonance and body resonance may be diversified depending on the size and so forth of the electronic musical instrument used. Accordingly, it is not preferable to fix the block size (for example, to fix the block size to the size which is based on the case where the impulse response data is the longest) in a configuration that no delay occurs in processing.

In addition, in one embodiment, since the reverberation-resonance unit 210 is prepared for each of the Lch effective sound input data 206 (Lch) and the Rch effective sound input data 206 (Rch), it is preferable to prepare at least two FIR filter arithmetic processing section 303, Accordingly, it becomes possible for the FIR filter arithmetic processing section 303 in one embodiment to execute FIR filter arithmetic processing that the filtration degree is made flexibly changeable and it becomes possible to simultaneously execute the plurality of types of FIR filter arithmetic processing while flexibly changing the combination thereof by the configuration which will be described in the following.

Now, it is supposed that FIR (1), FIR (2), . . . FIR (X−1), FIR (X) denote the FIR filter arithmetic processing sections respectively. In one embodiment, in addition to the Lch and Rch FIR filter arithmetic processing sections 303 which are illustrated in FIG. 3, other FIR filter arithmetic processing sections which are not particularly illustrated in FIG. 3 correspond to individual FIR filter arithmetic processing functions that one filter arithmetic processing device executes by time-division processing. Then, in one embodiment, sets of the FIR filter arithmetic processing which correspond to individual filtration degrees of the filters which are illustrated in FIG. 5 as the functional configuration example are executed by the FIR filter arithmetic processing sections FIR (1), FIR (2), . . . FIR (X−1) and FIR (X) in this order on the basis of time-division processing of a time-division length which correspond to each filtration degree in every sampling period. In this case, for example, the CPU 101 which operates as a control unit and is illustrated in FIG. 1 individually allocates each interval of continuous intervals which is set by being counted by a clock which has a period which is obtained by segmenting the sampling period and which has a length (the number of clocks) for which execution of the FIR filter arithmetic processing for each filtration degree is possible to each of the FIR filter arithmetic processing sections FIR (1), FIR (2), . . . FIR (X−1) and FIR (X) in the sampling period. Thereby, the CPU 101 makes, for example, a DSP (Digital Signal Processor) of the effect addition device 105 in FIG. 1 execute the FIR filter arithmetic processing of the amount of each filtration degree.

Figure 6:
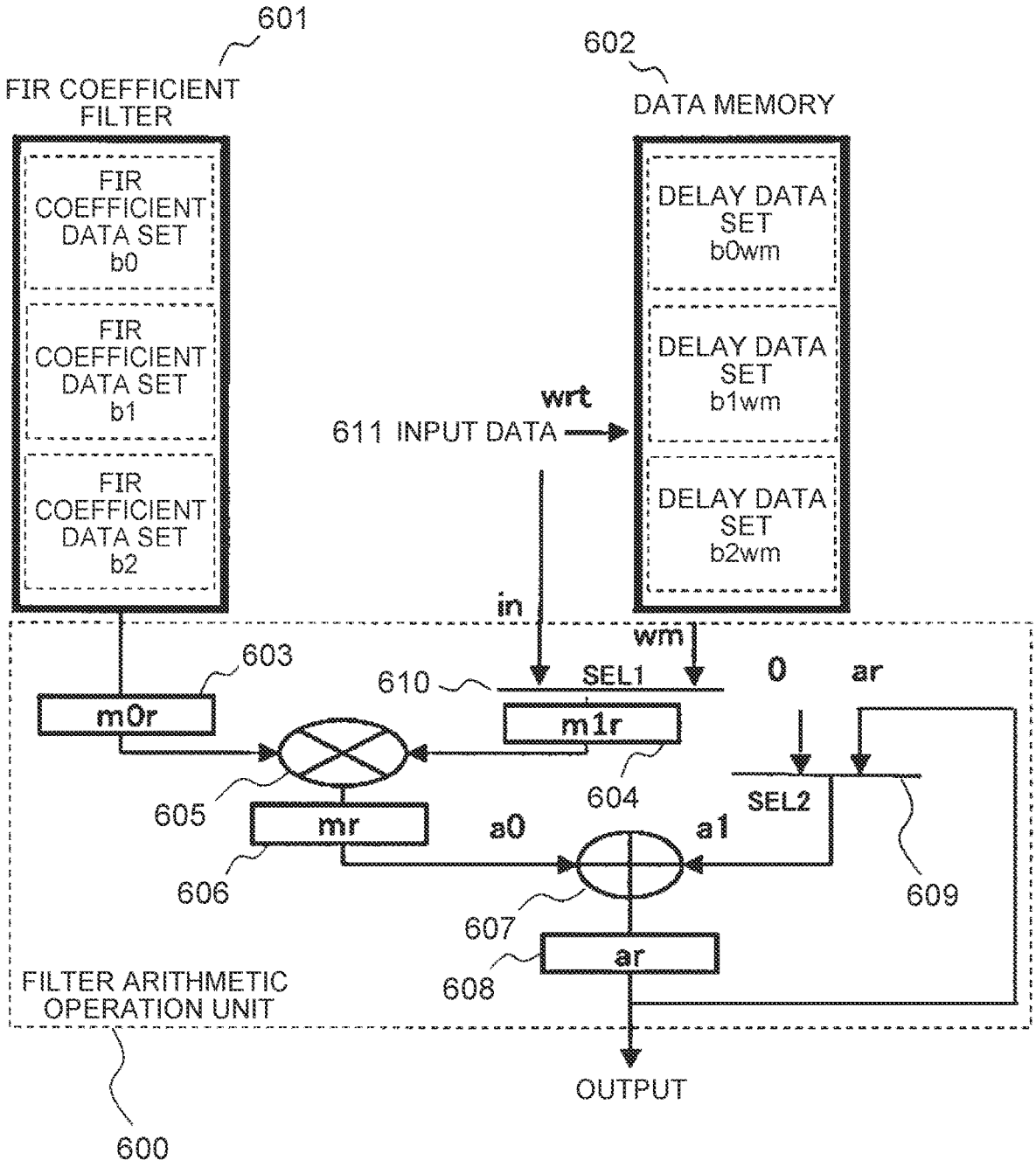
FIG. 6 is a diagram illustrating one hardware configuration example of a filter arithmetic operation unit.

FIG. 6 is a diagram illustrating one hardware configuration example of a filter arithmetic operation unit 600 which realizes each of the Lch and Rch FIR filter arithmetic processing sections 303 in FIG. 3 by the above-described time division processing.

An FIR coefficient memory 601 stores FIR coefficient data sets of the number which corresponds to the number of the filtration degrees of the FIR filter arithmetic processing in correspondence with one or more kinds of the FIR filter arithmetic processing sections FIR (1), FIR (2), . . . , FIR (X−1) and FIR (X) which are variable in filtration degree.

For example, three sets of FIR coefficient data sets b0, b1 and b2 which respectively correspond to three kinds of the FIR filter arithmetic processing sections FIR (1), FIR (2) and FIR (3) are stored into an FIR coefficient memory 601 in FIG. 6. The number of coefficients of the respective FIR coefficient data sets b0, b1 and b2 which are stored respectively correspond to the respective filtration degrees of the FIR filter arithmetic processing sections FIR (1), FIR (2) and FIR (3).

More specifically, for example, it is supposed that the FIR filter arithmetic processing sections FIR (1) and FIR (2) are the FIR filter arithmetic processing section 303 which is installed in the reverberation-resonance device 210 (Lch) which processes the Lch effective sound input data 206 (Lch) and the FIR filter arithmetic processing section 303 which is installed in the reverberation-resonance device 210 (Rch) which processes the Rch effective sound input data 26 (Rch) in FIG. 3. In this case, the FIR coefficient data set b1 which is stored into the FIR coefficient memory 601 is first 2N-based data set in the reverberant sound-resonant sound impulse response data for Lch. Likewise, the FIR coefficient data set b2 which is stored into the FIR coefficient memory 601 is first 2N-based data set in the reverberant sound-resonant sound impulse response data for Rch. The reason why the number of pieces of data in each data set is defined as 2N is as described with reference to FIG. 4.

In a data memory 602, ring-buffer type storage areas of the number for addresses of (each filtration degree −1) are secured for each of the FIR filter arithmetic processing sections FIR(1), FIR(2), . . . FIR(X−1) and FIR(X). Sets of input data 611 for the respective FIR filter arithmetic processing sections FIR(1), FIR(2), . . . FIR (X−1) and FIR(X) which ranges from the front of the current one sample to the front of the (filtration degree −1) sample are stored in the respective storage areas as delay data sets.

In the data memory 602 in FIG. 6, three ring-buffer type storage areas for the addresses of (each filtration degree −1) are secured for each of three kinds of the FIR filter arithmetic processing sections FIR(1), FIR(2) and FIR(3). Delay data sets b0*wm*, b1*wm* and b2*wm* are stored in the respective storage areas. The input data 611 which is generated in every sampling period is sequentially written into storage addresses of the storage areas while a write address is being sequentially incremented from a first address of the storage area in every sampling period in each storage area. In a case where the write address exceeds the final address of the storage area by incrementation, the write address is returned to the first address of the storage area and writing of the input data 611 is continuously performed. Delay data which ranges from the front of the current one sample to the front of the (filtration degree −1) sample is written into each storage area in a ring-shape in this way. In a case of data reading, the address is controlled to be read out in the ring-shape similarly to that in data writing in synchronization with a clock which is faster than a sampling clock and has the period which is obtained by segmenting the sampling period and thereby delay data which ranges from the front of the current one sample to the front of the (filtration degree −1) sample is read out from each storage area.

Now, for example, it is supposed that the FIR(1) is the FIR filter arithmetic processing section 303 for Lch in the reverberation-resonance unit 210(Lch). In this case, the input data 611 which corresponds to the FIR(1) is the Lch effective sound input data 206 (Lch). In addition, it is supposed that the sample value of the current sampling period of the Lch effective sound input data 206 (Lch) is b1in. In this case, in the Lch effective sound input data 206 (Lch), data which ranges from the sample value b1*wm*(1) which is obtained before one sampling period which is counted from the current to the sample value b1*wm*(2N−1) which is obtained before the (2N−1) sampling period is stored as the delay data set b1*wm* into the storage area which corresponds to FIR (1) of the data memory 602.

Likewise, it is supposed that the FIR(2) is the FIR filter arithmetic processing section 303 for Rch in the reverberation-resonance unit 210(Rch) in FIG. 3. In this case, the input data 611 which corresponds to the FIR(2) is the Rch effective sound input data 206 (Rch). In addition, it is supposed that the sample value of the current sampling period of the Rch effective sound input data 206 (Rch) is b2in. In this case, in the Rch effective sound input data 206 (Rch), data which ranges from the sample value b2*wm*(1) which is obtained before one sampling period which is counted from the current to the sample value b2*wm*(2N−1) which is obtained before the (2N−1) sampling period is stored as the delay data set b2*wm* into the storage area which corresponds to FIR (2) of the data memory 602.

Next, in FIG. 6, a first register (m0 *r*) 603, a first selector (SEL 1) 610, a second register (m1 *r*) 604, a multiplier 605, a third register (mr) 606, an adder 607, a fourth register (ar) 608 and a second selector (SEL2) 609 configure the filter arithmetic operation unit 600 which executes FIR multiplication/accumulation processes for 1 order. The filter arithmetic operation unit 600 realizes the function of the filter arithmetic operation unit 500 in FIG. 5.

In the filter arithmetic operation unit 600, the first register (m0*r*) 603 holds FIR coefficient data that the FIR coefficient memory 601 outputs in synchronization with a clock of a period which is obtained by segmenting the sampling period.

In the filter arithmetic operation unit 600, the first selector (SEL 1) 160 selects either the input data 611 of the current sampling period or delay data that the data memory 602 outputs.

In the filter arithmetic operation unit 600, the second register (m1*r*) 604 holds data that the selector (SEL 1) 160 outputs in synchronization with the clock.

In the filter arithmetic operation unit 600, the multiplier 605 multiplies FIR coefficient data that the first register (m0*r*) 603 outputs by data that the second register (m1*r*) 604.

In the filter arithmetic operation unit 600, the third register (mr) 606 holds multiplication result data that the multiplier 605 outputs in synchronization with the clock.

In the filter arithmetic operation unit 600, the adder 607 adds the multiplication result data that the third register (mr) 606 outputs and data that a selector (SEL 2) 609 which will be described later outputs together.

In the filter arithmetic operation unit 600, the fourth register (ar) 608 holds addition result data that the adder 607 outputs in synchronization with the clock.

In the filter arithmetic operation unit 600, the selector (SEL2) 609 selects either data which is zero in value or the addition result data that the fourth register (ar) 608 outputs and feeds back selected data to the adder 607 as accumulation data.

In the configuration in FIG. 6, in the process that each FIR filter arithmetic processing section FIR (i) ($1 \leq i \leq X$) executes, in the above-mentioned continuous intervals in the sampling period which is allocated in correspondence with execution of the process, the above-described filter arithmetic operation unit 600 repeatedly executes FIR multiplication/accumulation processes by the number of times which corresponds to the filtration degree, while sequentially inputting the FIR coefficient data which is stored in the FIR coefficient memory 601 which corresponds to the above-described FIR filter arithmetic processing section FIR (i) into the first register (m0*r*) 603 in synchronization with the clock and sequentially inputting the current input data 611 each of which corresponds to the FIR filter arithmetic processing section FIR (i) or the delay data which is output from the data memory 602 from the first selector (SEL1) 160 to the second register (m1*r*) 604, and outputs contents in the fourth register (ar) 608 as convolution result data at the completion of execution of the FIR multiplication/accumulation processes.

The time division processing is executed for every FIR filter arithmetic processing section FIR (i) (1X) in the independent continuous intervals in the sampling period which is allocated corresponding to the FIR filter arithmetic processing section FIR (i). Thereby, it becomes possible to execute the arithmetic operation(s) by the above one or more FIR filter arithmetic processing section(s) FIR (i) in time-division in every sampling period and it becomes possible to output each piece of convolution result data. In addition, it becomes possible for each FIR filter arithmetic processing section FIR (i) to flexibly cope with the filtration degree which depends on each application by storing the filter coefficient data sets which correspond to respective filtration degrees into the coefficient memory 601.

Following the arithmetic processing and data outputting that the FIR filter arithmetic processing section FIR (1) executes as above with no contradiction of the data, it becomes possible to execute the arithmetic processing and data outputting by the arithmetic processing section FIR (2) by the time-division process which synchronizes with the clock of the period which is obtained by segmenting the sampling period and thereby it becomes possible to execute the plurality of sets of FIR filter arithmetic processing that the filtration degrees are set individually in every sampling period with no delay. Thereby, for example, in a case where the impulse response data is short and so forth, it becomes possible to reduce the block size and then to use FIR resources which are obtained by block size reduction for another filtering process. In addition, in a case where the impulse response data is long, also the size of the coefficient data for convolution which is used in the CONV arithmetic processing section 304 in FIG. 3 is increased. Therefore, for example, in a case where the RAM which is implemented in the DSP which is the effect addition device 105 in FIG. 2 is used in common, when the block size N in the above-described CONV arithmetic processing section 304 is fixed, memory-bandwidth-dependent block size adjustment is impossible. However, since block size adjustment becomes possible by the configuration of one embodiment, it becomes possible to optimize the process in the effect addition device 105.

A result that actual coefficient data (the filtration degree=2N) is subjected to FFT arithmetic operation per block and a result that real coefficient data which comes after the above the actual coefficient data (the filtration degree=2N) is subjected to FFT arithmetic operation per block may be respectively stored in the RAM respectively for the FIR filter arithmetic processing section 303 in FIG. 3 and the CONV arithmetic processing section 304 in FIG. 3. However, in a case where the block size N is variable, storage of all block sizes leads to an increase in memory consumption. Accordingly, first, in a case where the impulse response data is stored into the RAM as the coefficient data and the block size N is decided in accordance with a previous reverberation time and a system condition of the electronic musical instrument 100, the first 2N data of the impulse response data which is stored in the RAM may be supplied to the FIR filter arithmetic processing section 303 and data which is obtained by converting data which comes after the 2N data by FFT arithmetic operation may be expanded on the RAM and may be supplied to the CONV arithmetic processing section 304. In a case where data expansion on the RAM is completed while the FIR filter arithmetic processing section 303 is processing data for N samples in the input data, there is no influence on the process that the CONV arithmetic processing section 304 executes.

In addition, in a case where each block size is decided by supposing, in advance, optimum setting, information on the block size and FFT conversion data for the CONV arithmetic processing section 304 are stored in the RAM and the block size N is decided when executing the convolution process, the value of the block size which is so decided may be compared with the block size information which is stored in the RAM and then FFT transform processing may be executed on the coefficient only when the block size is different from the size in the block size information which is stored in the RAM.

Figure 7:
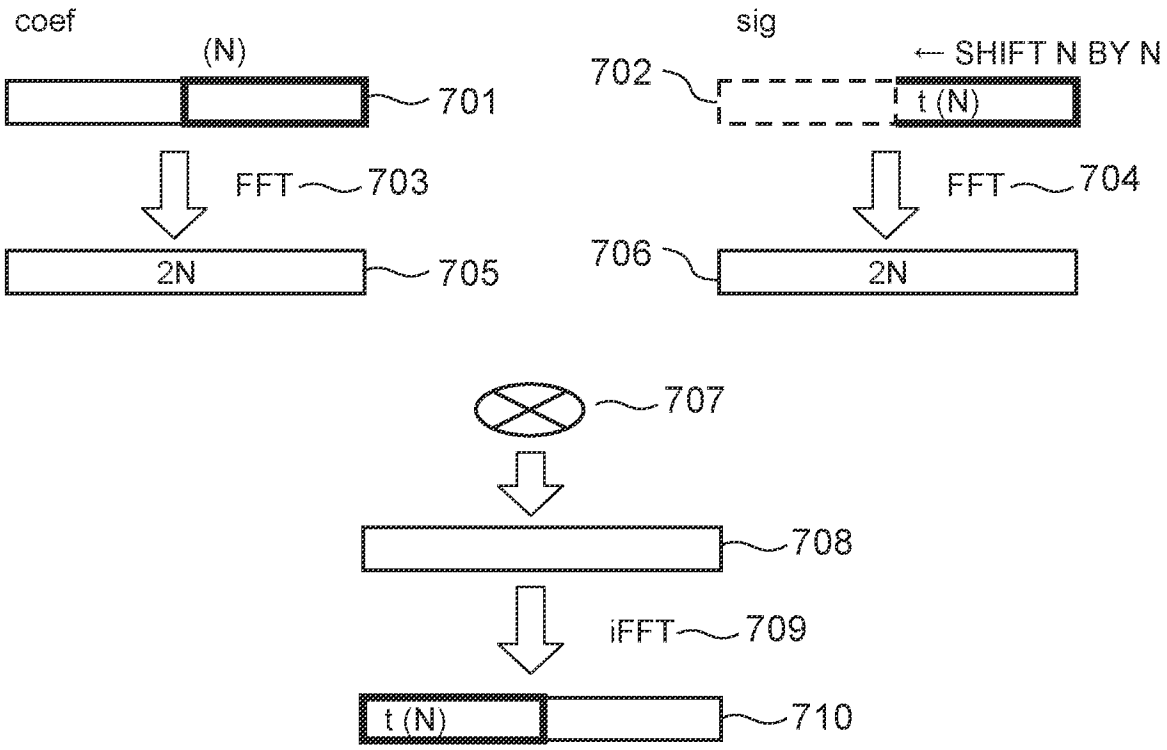
FIG. 7 is an explanatory diagram illustrating one example of one operation of the CONV arithmetic processing unit (a part 1).
Figure 8:
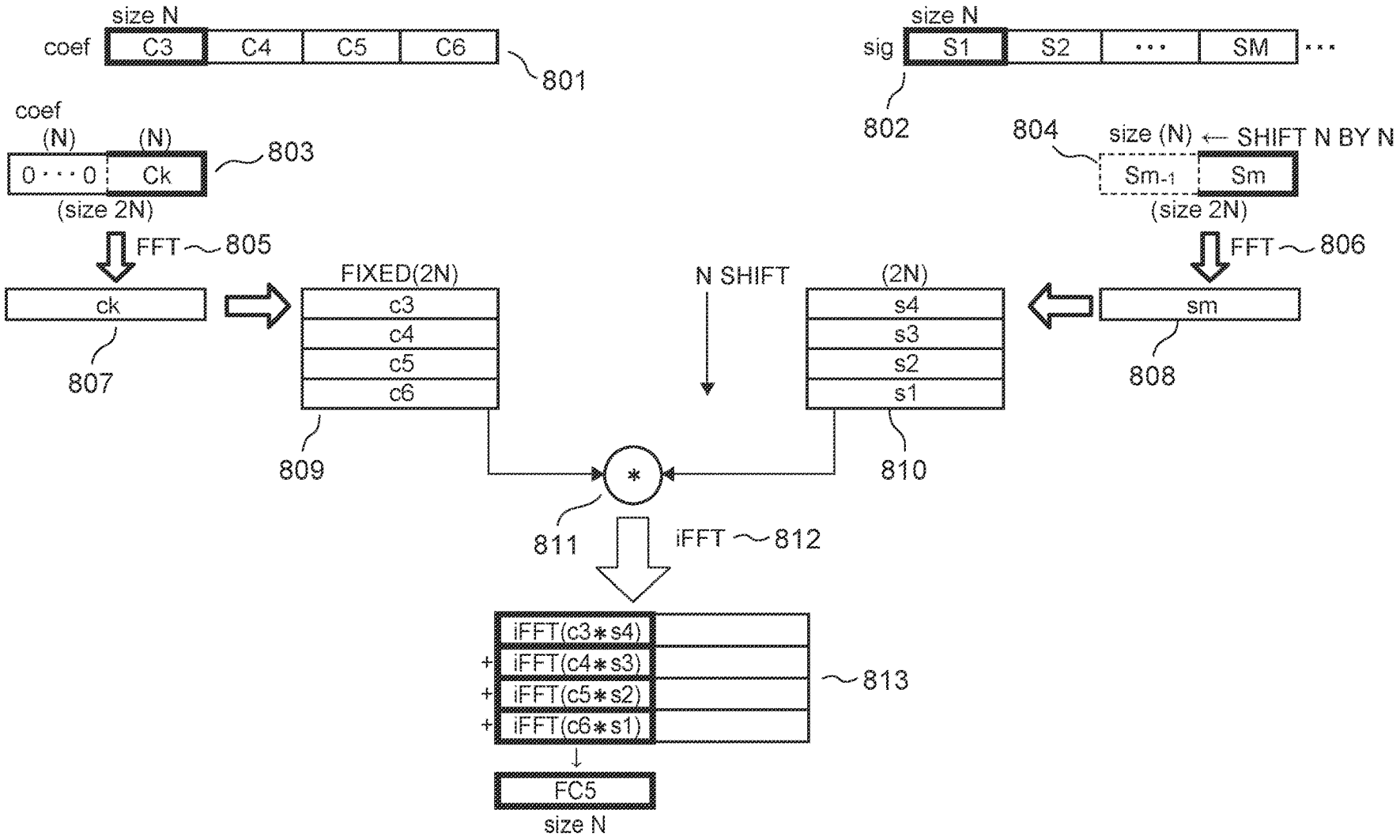
FIG. 8 is an explanatory diagram illustrating one example of another operation of the CONV arithmetic processing unit (a part 2).

FIG. 7 and FIG. 8 each illustrate an explanatory diagram illustrating one example of an operation of the CONV arithmetic processing section 304 in FIG. 3. First, FIG. 7 illustrates a convolution example that the block size is N (the number of samples). Convolution which is executed using the FFT arithmetic operation results in circular convolution as long as no measure is taken. Accordingly, in one embodiment, in a case where impulse response data (coef) and the Lch effective sound input data 206 (Lch) or the Rch effective sound input data 206 (Rch) (in the following, these pieces of data will be referred to as effective sound input data (sig) by putting them together with no distinction between Lch and Rch) are subjected to the FFT arithmetic operation respectively 2N by 2N, the convolution is executed so as to obtain block-based linear convolution.

In the example in FIG. 7, prior to execution of respective 2N-based FFT arithmetic operations 703 and 704, as denoted by 701, N-based zero data is added to N-based impulse response data (coef) (a thick-bordered part) and thereby 2N-based data is obtained. In addition, as denoted by 702, pieces of effective sound input data 206 (*sig*) are mutually overlapped while being shifted N (the block size) by N (a thick boarded part→a broken-lined thick bordered part) into the form of 2N-based data. Then, as a result that the FFT arithmetic operation is executed on the 2N-based data 701 which is generated from the impulse response data (coef) and the 2N-based data 702 which is generated from the effective sound input data 206 (*sig*) as denoted by 703 and 704 respectively, pieces of 2N-based frequency-domain data 705 and 706 are obtained.

Then, as denoted by 707, these pieces of the 2N-based frequency-domain 2N data 705 and 706 are subjected to complex multiplication per frequency point and thereby 2N-based complex multiplication result data 708 is obtained.

Further, as denoted by 709, as a result that an iFFT arithmetic operation is executed on the 2N-based complex multiplication result data 708, 2N-based time-domain data 710 which indicates execution of the convolution is obtained.

Then, front-half N-based data (a thick boarded part) of the 2N-based time domain data 710 indicates a result of execution of linear convolution by an N-based overlap save method and N-based data which is generated in this way is output as the Lch effective sound output data 211 (Lch) or the Rch effective sound output data 211 (Rch) in FIG. 3.

The arithmetic processing which includes the above-described FFT arithmetic processing and iFFT arithmetic processing and is executed by the CONV arithmetic processing section 304 corresponds to the CONV FFT arithmetic processing which is described before with reference to (e) in FIG. 4.

FIG. 8 illustrates one example of N-based CONV FFT arithmetic processing in a case where also the impulse response data (coef) side is divided N by N. In this example, N-based convolution results which are obtained after execution of the iFFT arithmetic processing "t" are added together and thereby it becomes possible to execute the CONV FFT arithmetic processing by dividing also a long-time impulse response into small N-based blocks.

Now, for simplification of description, it is assumed that in the description which is made with reference to FIG. 4, the impulse response data (coef) is divided into six blocks C1, C2, C3, C4, C5 and C6 N by N, on condition that N is the block size and, for example, K=6 as the number of blocks, and, as described with reference to FIG. 4, the leading 2 blocks (2N samples) C1 and C2 are arithmetically processed by the FIR filter arithmetic processing section 303 in FIG. 3 and, as denoted by 801 in FIG. 8, the blocks which are input into the CONV arithmetic processing section 304 are, for example, C3, C4, C5 and C6 which come after C1 and C2. In addition, it is also supposed that, as denoted by 802, the effective sound input data 206 (*sig*) is input in a state of being divided into M blocks of S1, S2, S3, S4, . . . SM also N by N.

Thereafter, similarly to the case in FIG. 7, prior to execution of respective 2N-based FFT arithmetic operations 805 and 806, as denoted by 803, each N-based zero data is added to each N-based division data (a thick boarded part) which is divided as described above in the impulse response data (coef) and thereby each 2N-based data is formed. In addition, as denoted by 804, respective pieces of N-based data which are obtained by dividing the effective sound input data 206 (*sig*) as described above are mutually overlapped while being shifted N by N and thereby 2N-based data (a thick boarded part→a broken-lined thick bordered part) is formed. Then, as a result that the FFT arithmetic operation is executed on the 2N-based data 803 which is generated from N-based data which is obtained by dividing the impulse response data (coef) and on the 2N-based data 804 which is generated from the effective sound input data 206 (*sig*) as denoted by 805 and 806 respectively, pieces of frequency domain data 807 (for example, c3, c4, c5, c6) and 808 (s1, s2, s3, s4, . . . , sM) are sequentially obtained 2N by 2N as denoted by 809 and 810. Here, it is possible to arithmetically process in advance by the FFT arithmetic operation and to preset, in a memory, pieces of divided data in the impulse response data (coef), for example, the 2N-based frequency data group 809, that is, for example, pieces of data c3, c4, c4, c5 and c6 which are generated from C3, C4, C5, and C6 (801 in FIG. 8) as long as no change occurs in the impulse response data (coef). In addition, 2N-based frequency data group 810 which is generated from the effective sound input data 206 (sig) may be sequentially stored into the memory in the ring buffer format, for example, as exemplified as s1, s2, s3 and s4, for example, in FIG. 8 by the number of divided pieces of data which is the same as the number of the frequency data group 809 (for example, pieces of data c3, c4, c5 and c6) which corresponds to the impulse response data (ceof).

Then, as denoted by 811, an arithmetic operation which is expressed in the following formula (1) is executed on the frequency data group 809, for example, c3, c4, c5, c6 and the frequency data group 810=s1, s2, s3, s4, . . . , sM which are sequentially obtained block by block. In the formula (1), K indicates the number of divided blocks of the impulse response data and, for example, K=6 as described above. In reality, as will be described later as "the number of CONV-1-processed blocks" by using FIG. 15, it is possible to set values, such as K=2, 50, 100, 150 blocks and so forth. In addition, k is variable data which is adapted to indicate each block number of the impulse response data. Further, in the formula (1), M is a block (N samples)-based data length of the effective sound input data 206 (*sig*). In addition, m is variable data which is adapted to indicate each block number of the effective sound input data 206 (*sig*). In addition, in the formula (1), ck indicates the 2N-based frequency data group 809 which is generated from divided data Ck in the impulse response data (coef). In addition, $s_{m-k+k-3}$ indicates the 2N-based frequency data group 810 which is generated from divided data $S_{m-k+k-3}$ in the effective sound input data 206 (*sig*). In the formula (1), iFFT indicates an inverse fast Fourier transform arithmetic operation 812 which is executed on 2N-based frequency data in parenthesis. Then, in the formula (1), $FC_m$ indicates front-half N-based data in the 2N-based time domain data 813 which corresponds to the divided data Sm in the effective sound input data 206 (*sig*) and which is a result of execution of the CONV FFT arithmetic processing (see (f) in FIG. 4).

$$FC_m = \sum_{m=1}^{M+K-1} \sum_{k=3}^{K} iFFt(c_k * s_{m-k+K-3}) \tag{1}$$

In this arithmetic operation, the complex arithmetic operation is executed at every frequency point 2N by 2N as "$c_k$*$s_{m-k+k-3}$ and thereby each piece of 2N-based complex arithmetic operation result data is obtained, further, the iFFT arithmetic operation is executed on these pieces of 2N-based complex arithmetic operation result data and the formula (1) is arithmetically operated. As a result, 2N-based time domain data 813 on which convolution is executed is obtained.

Then, each piece of front-half N-based data (the thick bordered part) in each piece of the 2N-based time domain data 813 is added by the number of blocks of the impulse response data, for example, as exemplified in the following formula (2).

$$FC5=\text{iFFT}(c3*s4)+\text{iFFT}(c4*s3)+\text{iFFT}(c5*s2)+\text{iFFT}(c6*s1) \tag{2}$$

As indicated in FIG. 4 as the block timings T4 and T5, an arithmetic operation result FC5 in the formula (2) which is arithmetically operated at the block timing 14 is output at the next block timing T5 as the effective sound data 211 (the Lch effective sound output data 211 (Lch) or the Rch effective sound output data 211 (Rch))=CO5 in FIG. 3.

Figure 9:
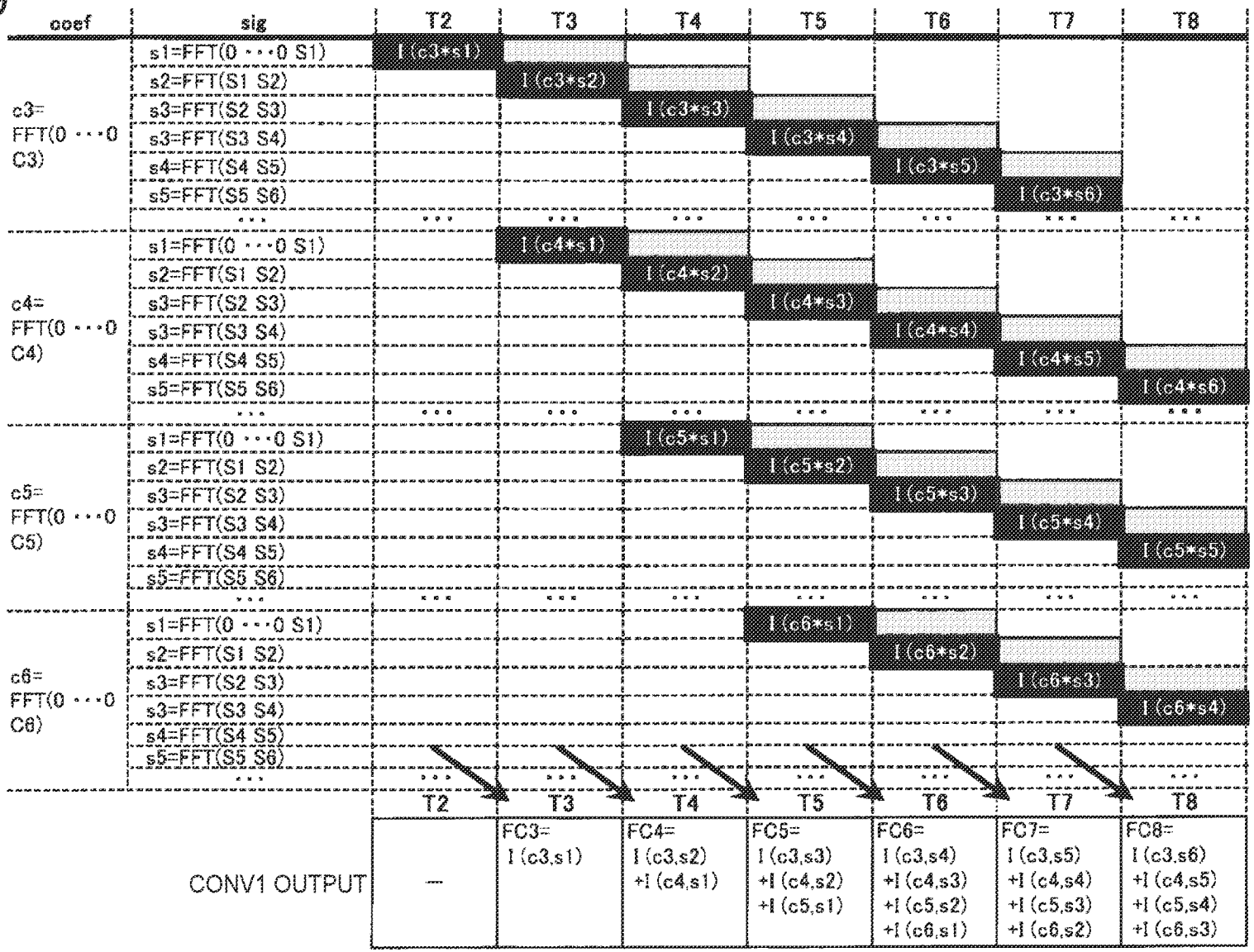
FIG. 9 is an explanatory diagram illustrating one detailed operation example of the CONV arithmetic processing unit.

FIG. 9 is a diagram illustrating a simple calculation example which is used for describing operations of the CONV arithmetic processing section 304 which is based on the above formula (1) by the CONV arithmetic processing block which is illustrated in FIG. 8 and which configures the CONV arithmetic processing section 304 in FIG. 3. In FIG. 8, the block timings T2, T3, . . . correspond to the above-described block timings T2, T3, . . . in FIG. 4. In addition, in the following, an example of a case where, in the impulse response data, the number of the divided blocks K=6 in the above-described formula (1) will be described.

First, the CONV arithmetic processing section 304 executes the CONV FFT arithmetic processing which is indicated by the formula (1) in which K=6 and m=1 at the block timing T2 in parallel with execution of the convolution arithmetic operation by the FIR filter arithmetic processing section 303 in FIG. 3 at the block timings T1 and T2, as described before with reference to FIG. 4. As a result, the following arithmetic operation is executed while changing the value of k from 3 to 6 (K=6) as the arithmetic operation of Σ on the right inner side of the formula (1).

$$\text{iFFT}(c3*s1)+\text{iFFT}(c4*s0)+\text{iFFT}(c5*s-1)+\text{iFFT}(c6*s-2)$$

Here, no sample is present for s0, s−1 and s−2. Accordingly, the CONV arithmetic processing section 304 executes only the arithmetic operation of "iFFT (c3*s1)" (in FIG. 9, noted as "1(c3*s1)" in the abbreviated form, the same shall apply hereinafter) as the CONV FFT arithmetic processing fc3 (see (e) in FIG. 4) as indicated as blacked parts of the block timing T2 in FIG. 9. Then, the CONV arithmetic processing section 304 outputs N-based CONV FFT arithmetic processing output data FC3 (see (f) in FIG. 4) which is a result of execution of the arithmetic operation which is obtained as a result of execution of the above arithmetic processing as a convolution execution output signal CO3 (see (g) in FIG. 4) at the block timing T3.

Next, the CONV arithmetic processing section 304 executes the CONV FFT arithmetic processing which is expressed by the formula (1) in which K=6 and m=2 at the block timing T3. As a result, the following arithmetic operation is executed while the value k is being changed from 3 to 6 (K=6) as the arithmetic operation of Σ on the right inner side of the formula (1).

$$iFFT(c3*s2)+iFFT(c4*s1)+iFFT(c5*s0)+iFFT(c6*s-1)$$

Here, no sample is present for s0 and s−1. Therefore, the CONV arithmetic processing section 304 executes the arithmetic operation of "iFFT (c3*s2)+iFFT (c4*s1)" as the CONV FFT arithmetic processing fc4 (see (e) in FIG. 4) as indicated as blacked parts of the block timing T3 in FIG. 9. Then, the CONV arithmetic processing section 304 outputs N-based CONV FFT arithmetic processing output data FC4 (see (f) in FIG. 4) which is the result of an arithmetic operation which is obtained as a result of execution of the above arithmetic processing as a convolution execution output signal CO4 (see (g) in FIG. 4) at the block timing T4.

Then, the CONV arithmetic processing section 304 executes the CONV FFT arithmetic processing which is expressed by the formula (1) in which K=6 and m=3 at the block timing T3. As a result, the following arithmetic operation is executed while the value k is being changed from 3 to 6 (K=6) as the arithmetic operation of Σ on the right inner side of the formula (1).

$$iFFT(c3*s3)+iFFT(c4*s2)+iFFT(c5*s1)+iFFT(c6*s0)$$

Here, no sample is present for s0. Therefore, the CONV arithmetic processing section 304 executes the arithmetic operation of "iFFT (c3*s3)+iFFT (c4*s2)+iFFT (c5*s1)" as the CONV FFT arithmetic processing fc5 (see (e) in FIG. 4) as indicated as blacked parts of the block timing T4 in FIG. 9. Then, the CONV arithmetic processing section 304 outputs N-based CONV FFT arithmetic processing output data FC5 (see (f) in FIG. 4) which is the result of an arithmetic operation which is obtained as a result of execution of the above arithmetic processing as a convolution execution output signal CO5 (see (g) in FIG. 4)) at the block timing T5.

Further, the CONV arithmetic processing section 304 executes CONV FFT arithmetic processing which is expressed by the formula (1) in which K=6 and m=4 at the block timing T3. As a result, the following arithmetic operation is executed while the value k is being changed from 3 to 6 (K=6) as the arithmetic operation of Σ on the right inner side of the formula (1).

$$iFFT(c3*s4)+iFFT(c4*s3)+iFFT(c5*s2)+iFFT(c6*s1$$

Here, accordingly, the CONV arithmetic processing section 304 executes the arithmetic operation of "iFFT(c3*s4)+iFFT(c4*s3)+iFFT(c5*s2)+iFFT(c6*s1)" as CONV FFT arithmetic processing fc6 (see (e) in FIG. 4) as indicated as blackened parts of the block timing T5 in FIG. 9 as CONV FFT arithmetic processing fc6 (see (e) in FIG. 4). Then, the CONV arithmetic processing section 304 outputs N-based CONV FFT arithmetic processing output data FC6 (see (f) in FIG. 4) which is a result of execution of an arithmetic operation which is obtained as a result of execution of the above arithmetic operation as a convolution execution output signal CO6 (see (g) in FIG. 4) at the block timing T6.

Then, the CONV arithmetic processing section 304 executes the same CONV FFT arithmetic processing while incrementing the value of m+1 by +1 up to M+K−1 in accordance with the formula (1) similarly.

Figure 10:
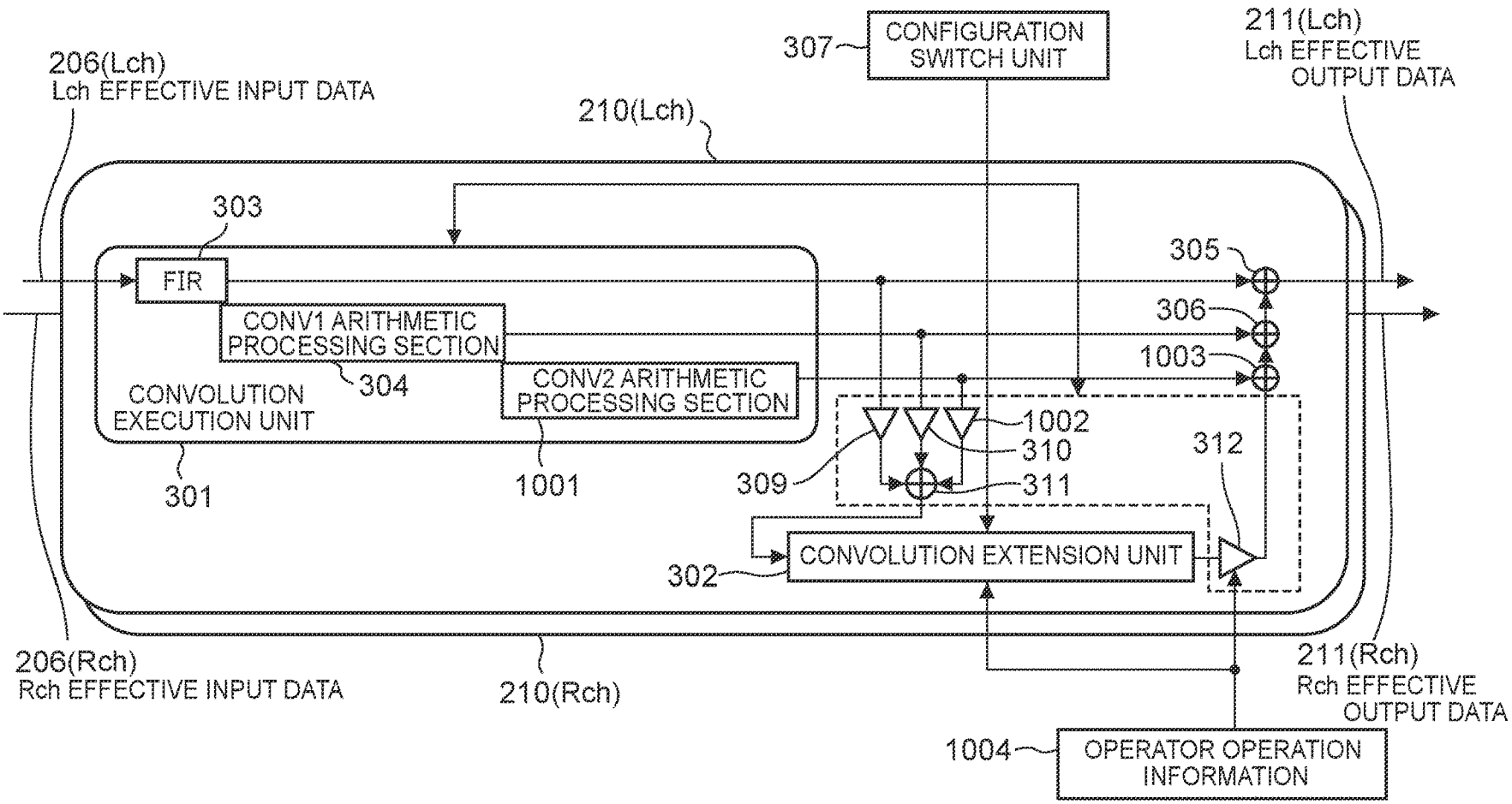
FIG. 10 is a block diagram illustrating one example of the reverberation-resonance unit in the effect addition device according to another embodiment of the present invention.

FIG. 10 is a block diagram illustrating one example of the reverberation-resonance unit 210 in FIG. 2 in another embodiment of the present invention. In comparison with the reverberation-resonance unit 210 in one embodiment in FIG. 3, the reverberation-resonance unit 210 in FIG. 10 is different in the point that the convolution execution unit 301 further includes a CONV 2 arithmetic processing section 1001 at the rear stage of the CONV arithmetic processing section 304. Incidentally, in another embodiment in FIG. 10, the CONV arithmetic processing section 304 which is installed at the front stage and is illustrated in FIG. 3 is newly designated as a CONV 1 arithmetic processing section 304. Although two CONV arithmetic processing sections are installed in another embodiment in FIG. 10, three or more CONV arithmetic processing sections may be installed.

Here, it is possible to increase the block size of the FFT arithmetic processing in the CONV2 arithmetic processing section 1001 to, for example, 2N which is twice the block size N of the CONV FFT arithmetic processing in the CONV1 arithmetic processing section 304. Thereby, it becomes possible to set such that, as described the above, the FIR filter arithmetic processing section 303 executes the real-time convolution arithmetic operation on the first 2N samples in a case where N samples are set as the unit of each block, the CONV1 arithmetic processing section 304 executes the N-based CONV FFT arithmetic processing, for example, on the next 2N samples and then the CONV2 arithmetic processing section 1001 executes the 2N-based CONV FFT arithmetic processing on the succeeding samples. An arithmetic operation amount of the 2N-based FFT arithmetic processing or the 2N-based iFFT arithmetic processing is smaller than an arithmetic operation amount which is obtained in a case of executing the N-based FFT arithmetic processing or the N-based iFFT arithmetic processing two times. On the other hand, in a case where the arithmetic operation interval of the impulse response data is doubled, although the time taken until a result of execution of the convolution arithmetic operation is output is increased, the arithmetic operation efficiency is increased. Accordingly, in another embodiment in FIG. 10, the FIR filter arithmetic processing section 303 takes charge of the leading 2N-based interval that the amplitude level of the impulse response data is the highest, the CONV 1 arithmetic processing section 304 which executes the N-based arithmetic processing takes charge of, for example, the next 2N-based interval that the amplitude level is still high, and the CONV2 arithmetic processing section 1001 which executes the 2N-based arithmetic processing takes charge of succeeding intervals that the amplitude level is lowered. Thereby, it becomes possible to execute the convolution that the convolution response and the arithmetic operation efficiency are maintained in a well-balanced state.

In FIG. 10, such a configuration is possible that respective outputs from the FIR filter arithmetic processing section 303, the CONV1 arithmetic processing section 304 and the CONV2 arithmetic processing section 1001 are added together via the addition units 305 and 306 and an addition unit 1003 respectively and are output as the Lch effective sound output data 211 (Lch) or the Rch effective sound output data 211 (Rch). In addition, such a configuration is also possible that the respective outputs from the FIR filter arithmetic processing section 303, the CONV 1 arithmetic processing section 304 and the CONV 2 arithmetic processing section 1001 are multiplied by respective level values which are set by the configuration switch unit 307 which will be described later by the multipliers 309 and 310, and an multiplier 1002 respectively and then respective results of multiplication are added together by the adder 311 and a result of addition is input into the convolution extension unit 302. Operator operation information 1004 in FIG. 10 will be described later.

Figure 11:
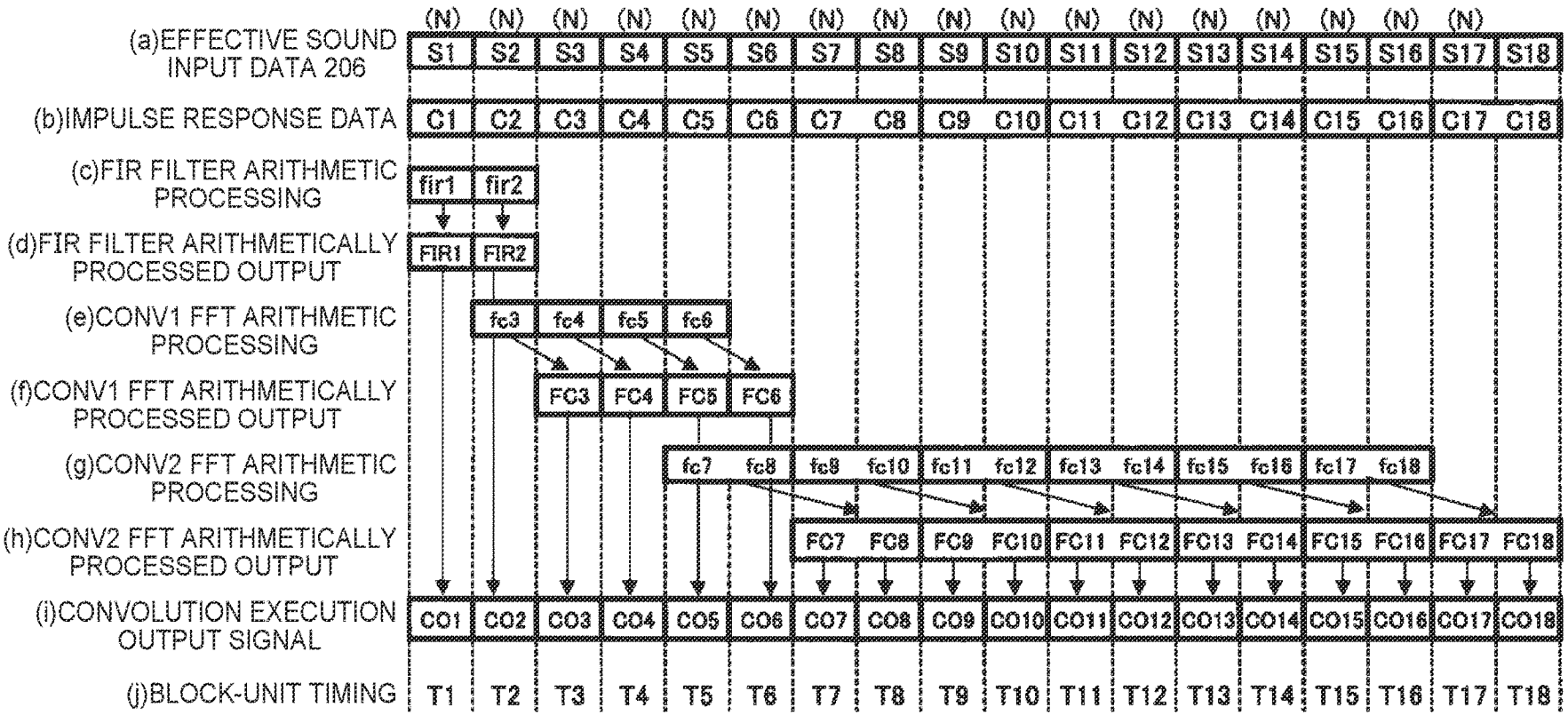
FIG. 11 is an explanatory diagram illustrating one example of a timing relation among the FIR arithmetic processing unit, a CONV 1 arithmetic processing unit and a CONV 2 arithmetic processing unit of the reverberation-resonance unit in another embodiment of the present invention.

FIG. 11 is an explanatory diagram illustrating one example of a timing relation among the FIR arithmetic processing section 303, the CONV1 arithmetic processing section 304 and the CONV2 arithmetic processing section 1001 in the reverberation-resonance unit 210 in another embodiment which is illustrated in FIG. 10.

In comparison with the case of the reverberation-resonance unit 210 according to one embodiment which is illustrated in FIG. 3, in the timing relation in FIG. 11, it becomes possible to acquire the reverberation-resonance sound impulse response data for a longer period of time, ranging from the block C1 to the block C18 in FIG. 11 in comparison with a range from the block C1 to the block C6 in one embodiment in FIG. 4. Then, the FIR filter arithmetic processing section 303 takes charge of the blocks C1 and C2 as in the case in FIG. 4 and the CONV1 arithmetic processing section 304 (corresponding to the CONV arithmetic processing section 304 in FIG. 4) takes charge of four blocks such as, for example, the blocks C3, C4, C5 and C6 as in the case in FIG. 4. Accordingly, the timing relation in FIG. 11 is the same as the timing relation in FIG. 4 ranging from the block timing T1 to the block timing T6.

In the example in FIG. 11, in a case of outputting the convolution execution output signals at the block timing T7 and succeeding block timings, the CONV 2 arithmetic processing section 1001 in FIG. 10 executes the 2N-based CONV FFT arithmetic processing. In this case, because the block size is doubled, also the processing delay reaches 4N which is twice as long as 2N which is attained in a case where the block size is N. Accordingly, the CONV 2 arithmetic processing section 1001 starts execution of the 2N-based CONV FFT arithmetic processing at the block timing T5 which comes earlier than the block timing T7 at which the output is started by the amount of 2N samples as indicated in (g) in FIG. 11. Then, as indicated in (g) in FIG. 11, the CONV 2 arithmetic processing section 1001 executes respective types of the CONV FFT arithmetic processing fc7 and fc8 on pieces of the effective sound input data 206 for 2N samples which are input at the block timings T3 and T4 and are indicated in (a) in FIG. 11 in the 2N-based duration between the block timings T5 and T6 as indicated in (g) in FIG. 11. Then, the CONV2 arithmetic processing section 1001 outputs pieces of CONV FFT arithmetically processed output data FC7 and FC8 for 2N samples which are obtained as results of execution of the arithmetic processing sequentially as convolution execution output signals CO7 and CO8 in synchronization with the sampling period in the 2N-based duration between the block timings T7 and T8 as indicated in (h) in FIG. 11. Thereafter, it is possible for the CONV2 arithmetic processing section 1001 to execute the CONV FFT arithmetic processing and to output the signals 2N by 2N with no delay in the same manner as the above.

Here, in a case where the convolution is used for the purpose of reverberation and so forth, in general, since a high-band frequency is attenuated toward the latter half part of the reverberation, the CONV FFT arithmetic processing to be executed by the CONV2 arithmetic processing section 1001 may be executed by lowing the sampling rate. In this case, it becomes possible to more improve the arithmetic operation efficiency and thereby it becomes possible to execute the convolution that the arithmetic operation accuracy and the arithmetic operation efficiency are maintained in a well-balanced state.

Figure 12:
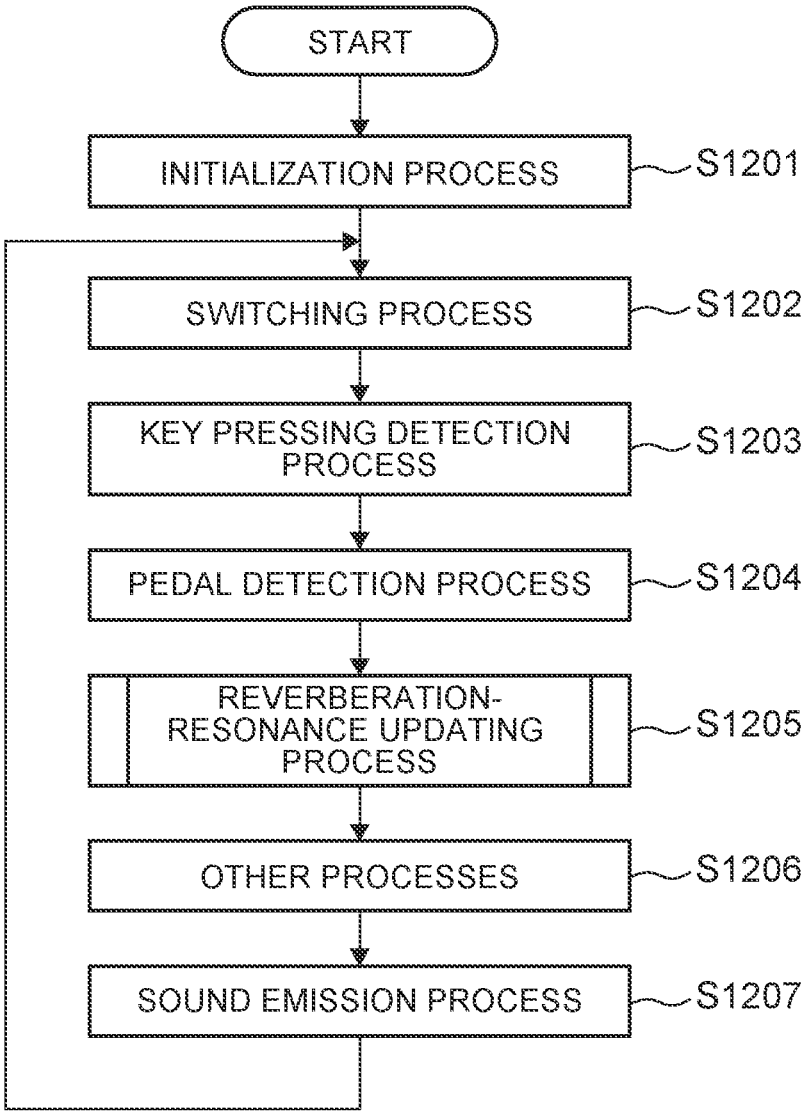
FIG. 12 is a main flowchart illustrating one example of control processing of an entire operation.

FIG. 12 is a flowchart illustrating one example of control processing of the entire operation that the CPU 101 in FIG. 1 executes for realizing the reverberation-resonance devices 210 in FIG. 2 and FIG. 10. This control processing is an operation that the CPU 101 executes a control processing program which is loaded from the ROM 102 to the RAM 103.

In the electronic musical instrument 100 in FIG. 1, after a power source switch of the operator 108 is turned on, the CPU 101 starts execution of the control processing which is illustrated as a main flowchart in FIG. 12. First, the CPU 101 initializes the contents which are stored in the RAM 103, the state of the sound source (TG) 104, the state of the effect addition device 105 and so forth in FIG. 1 (step S1201). Then, the CPU 101 repeatedly executes a series of processes in step S1202 to step S1207 until the power source switch is turned off.

In repeated execution of the above processes, first, the CPU 101 executes a switching process (step S1202). Here, the CPU 101 detects an operation state of the operator 108 in FIG. 1.

Next, the CPU 101 executes a key-pressing detection process (step S1203). Here, the CPU 101 detects a state where the keyboard 106 in FIG. 1 is pressed.

Next, the CPU 101 executes a pedal detection process (step S1204). Here, the CPU 101 detects an operation state of the pedal 107 in FIG. 1.

Next, the CPU 101 executes a reverberation-resonance updating process (step S1205). Here, the CPU 101 makes the effect addition device 105 execute addition of the reverberation-resonance effect by the reverberation-resonance unit 210 (Lch) and the reverberation-resonance unit 210 (Rch) in FIG. 3 to the Lch effective sound input data 205 (Lch) and the Rch effective sound input data 206 (Rch) which are illustrated in FIG. 2 and that the sound source (TG) 104 generates on the basis of the result of detection of the operation state of the operator 108 for addition of the reverberation-resonance effect in step S1202 and the result of detection of the operation state of the pedal 107 in step S1204.

Next, the CPU 101 executes other processes (step S1206). Here, the CPU 101 executes, for example, a process of controlling the musical sound envelope and so forth.

Then, the CPU 101 executes a sound emission process (step S1207). Here, the CPU 101 gives sound emission instructions to the sound source (TG) 104 on the basis of the state where the keyboard 106 is pressed (or detached) in the key-pressing detection process in step S1203.

Figure 13A:
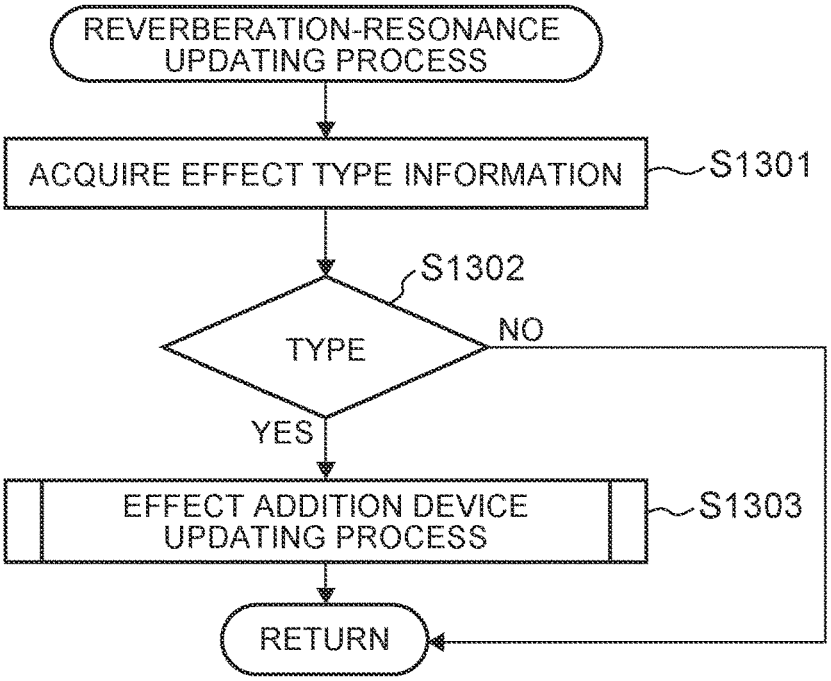
FIG. 13A is a flowchart illustrating one example of a reverberation-resonance updating process.

FIG. 13A is a flowchart illustrating one detailed process example of the reverberation-resonance updating process in step S1205 in FIG. 12.

First, the CPU 101 acquires effect type information (step S1301) by referring to the ROM 102 in FIG. 1 on the basis of the result of detection of the operation state of the operator 108 for addition of the reverberation-resonance effect in step S1202 (step S1301).

Next, the CPU 101 decides whether the type of effect is designated by the operator 108 (step S1302).

In a case of YES in decision in step S1302, the CPU 101 executes the process of updating the effect addition device 105 in FIG. 1 (step S1303). In a case of NO in decision in step S1302, the CPU 101 skips the process in step S1303. Then, the CPU 101 terminates execution of the reverberation-resonance updating process in the flowchart in FIG. 13A and returns to repeated execution of the processes in the main flowchart in FIG. 12.

Figure 13B:
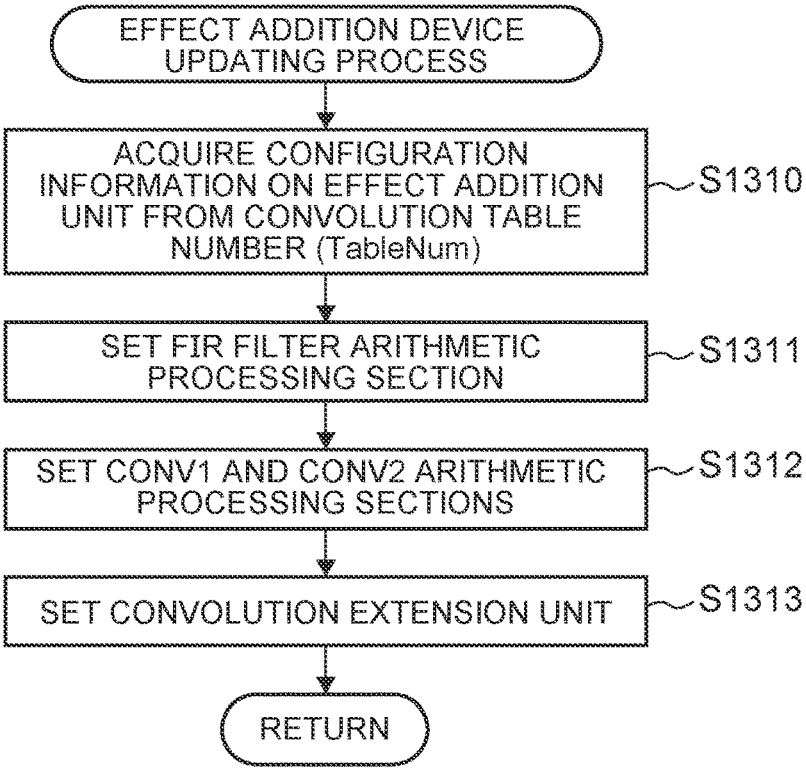
FIG. 13B is a flowchart illustrating one example of an effect addition updating process.

FIG. 13B is a flowchart illustrating one example of details of the process of updating the effect addition device 105 in step S1303 in FIG. 13A and indicates a function which corresponds to the configuration switch unit 307 in FIG. 10 (also may correspond to the configuration switch unit 307 in FIG. 3).

First, the CPU 101 acquires the configuration information of the effect addition device 105 with reference to the convolution table which is stored in the ROM 102 in FIG. 1 with the type of the effect which is acquired in step S1301 in FIG. 13A being set as a convolution table number (step S1310).

FIG. 14 is a diagram illustrating one configuration example of one convolution table 1401 which is referred to by using the convolution table number. Data in the convolution table 1401 is configured by "Impulse Response Data" and "Configuration Information on Effect Addition Device 105" per data which is referred to by using the convolution table number.

"Configuration Information on Effect Addition Device 105" is configured by "Block Size Information" which indicates the number of block sizes and "Number of Samples IN N".

"Convolution Execution Setting Information" is configured by "Number of CONVs" (1 in a case where only the CONV1 arithmetic processing section 304 is used and 2 in a case where the CONV2 arithmetic processing section 1001 is also used), "Number of Blocks" that each CONV arithmetic processing section processes, and "Sampling Rate".

"Convolution Extension Unit Setting Information" is configured by "Comb Setting Information", "APF Setting Information" (see FIG. 3B) and "Level Value" (input/output volume setting information of each multiplier).

In FIG. 13B, the CPU 101 decides the degree of FIR in the FIR filter arithmetic processing section 303 on the basis of the block size information in the convolution table 1401 which is exemplified in FIG. 14, following step S1310. Then, the CPU 101 operates to store first 2×the number of degrees of the impulse response data which is stored in the ROM 102 (or loaded from the ROM 102 and stored the RAM 103 in the DSP of the effect addition device 105 in FIG. 1) in the FIR coefficient memory 601 which is illustrated in FIG. 6 and which configures the FIR filter arithmetic processing section 303 and updates the data (step S1311).

Next, the CPU 101 acquires the convolution execution setting information (the block size information, the number of blocks to be processed and the sampling rate information) from the convolution table 1401 and executes setting on the CONV1 arithmetic processing unit 304 and the CONV2 arithmetic processing section 1001 of the convolution execution unit 301 in FIG. 10 on the basis of parameters of these pieces of information (step S1312).

Finally, the CPU 101 sets respective parameters on the basis of the delay time (dn) and the coefficient (gn) of APF (All Pass Filter), the delay time (dn), the coefficient (gn) and level setting (cn) of each Comb (see FIG. 3B), the multiplication level value information on the multipliers 309, 310 and 1002 on the input side of the convolution extension unit 302, and the multiplication level value information on the multiplier 312 on the output side of the convolution extension unit 302 which are the convolution extension unit setting information in the convolution table 1401 (step S1313).

Then, the CPU 101 terminates execution of the process of updating the effect addition device 105 in step S1303 which is indicated in FIG. 13A and is indicated as the flowchart in FIG. 13B and terminates execution of the reverberation-resonance updating process in step S1205 in FIG. 12.

As factors for changing the configuration of the convolution table 1401, the following factors and so forth are conceived of, depending on the length and application of the impulse response data on the reverberation-resonance sound (see FIG. 14).

The convolution extension unit 301 which is illustrated in FIG. 10 is not used.→This is a case where it is wished to give importance to reproducibility.

Both the convolution execution unit 301 and the convolution extension unit 302 in FIG. 10 are used.→This is a case where it is wished to dynamically operate the parameters and/or it is wished to reduce a processing load.

All the FIR filter arithmetic processing section 303, the CONV1 arithmetic processing section 304, the CONV2 arithmetic processing section 1001 and the convolution extension unit 302 in the convolution execution unit 301 are used.→This is a case where it is wished to dynamically operate the parameters while executing long-time convolution.

The configuration of the convolution table 1401 may be appropriately set depending on, for example, the type of the reverberation (a room (the impulse response is short) . . . a hall (the impulse response is long) and so forth) and presence/absence of parameters that a user operates.

Since volumes are set for every CONV arithmetic processing section 1001 individually for the FIR filter arithmetic processing section 303 and the CONV1 arithmetic processing section 304, as for inputting of a signal into the convolution extension unit 302, it is possible to select the signal to be input into the convolution extension unit 302. Thereby, in a case where the leading part of the impulse response data has a unique feature and, for example, in a case where it is not wished to give a characteristic part such as initial reflection of a room and so forth to the convolution extension unit 302, it is possible to generate a convolution extension signal without giving the unique-feature portion of the leading part of the impulse response data to the convolution extension unit 302 by suppressing the level value of the multiplier 309. On the other hand, in a case where both of the CONV1 arithmetic processing section 304 and the CONV2 arithmetic processing section 1001 are to be operated, it is possible to generate the convolution extension signal without giving the unique-feature portion of the leading part of the impulse response data to the convolution extension unit 302 by suppressing the level value of the multiplier 310. In addition, the multiplier 312 which is installed on the output side of the convolution extension unit 302 is adapted to appropriately adjust the level of the output depending on input setting.

Figure 15:
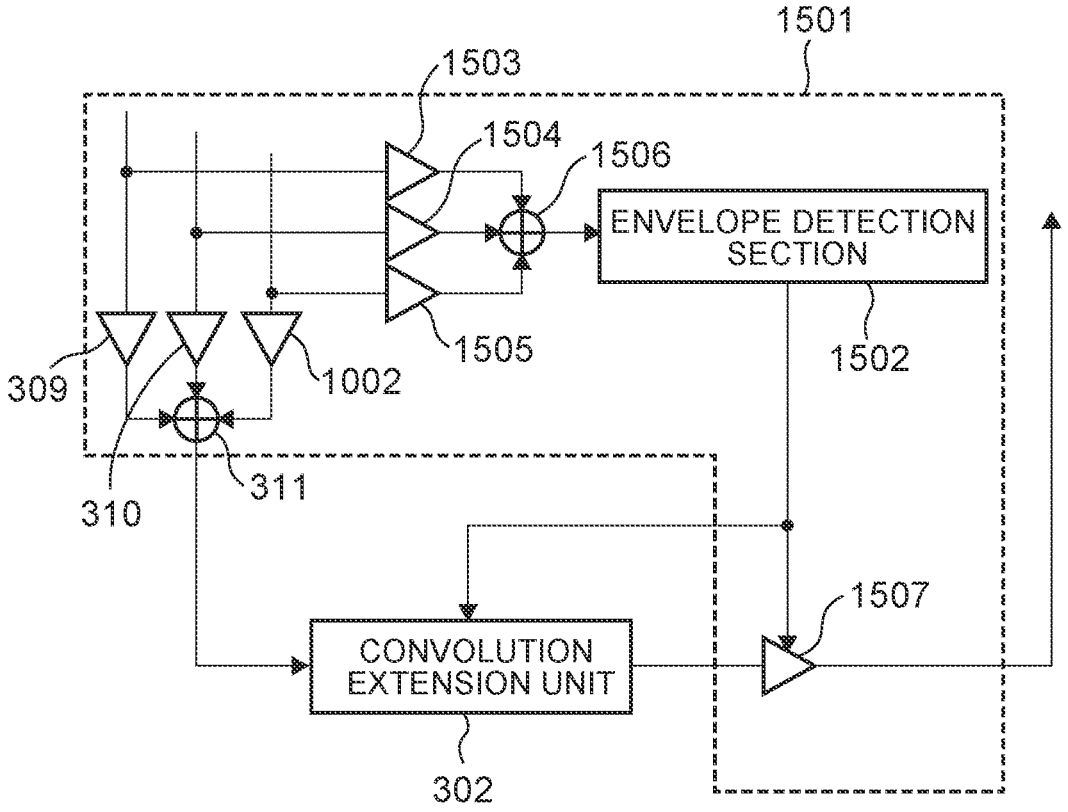
FIG. 15 is a diagram illustrating one configuration example of an envelope detector which is capable of operating a level of a convolution extension unit.

FIG. 15 is a diagram illustrating one configuration example of an envelope detector 1501 which is capable of operating the level of the convolution extension unit 302. Similarly to inputting of the signal into the convolution extension unit 302, multipliers 1503, 1504 and 1505 multiply signals which are input into convolution execution unit 301 and are output from the FIR filter arithmetic processing section 303, the CONV1 arithmetic processing section 304 and the CONV2 arithmetic processing section 1001 by level values respectively. Then, an adder 1506 outputs a value which is obtained by adding together results of multiplication. Then, an envelope detection unit 1502 takes an absolute value of an output signal from the adder 1506, performs a low-pass filtering process and so forth on the signal and then outputs envelope detection signal data.

For example, controlling operations as follows are performed by using an envelope detection level in this envelope detection signal data.

In the multiplier 1507, a level value to be output to the convolution extension unit 302 is controlled depending on the envelope detection level.

In a case where the envelope detection level becomes less than a predetermined level, a set value to be output to the convolution extension unit 302 is increased by using the multiplier 1507.

In a case where the envelope detection level becomes more than the predetermined level, the set value to be output to the convolution extension unit 302 is decreased by using multiplier 1507.

As an alternative, as another embodiment, the convolution extension unit 302 may receive an input signal, may generate a long-time convolution extension signal and may set an output level of the long-time convolution extension signal by using the envelope detection signal data. In this case, such a usage is conceivable that only the output from the CONV2 arithmetic processing section 1001 is used for envelope detection in a state of making the signal pass through the multipliers 309, 310 and 1002 which are installed on the input side of the convolution extension unit 302 with the level value=1.

In addition, the configuration is made such that in a case where the impulse response data has the unique feature in one interval, this interval is allocated to the FIR filter arithmetic processing section 303 in a sound which corresponds to early reflection and so forth, and then setting is made such that no input signal is sent to the convolution extension unit 302, that is, the level value of the multiplier 309 is lowered. Thereby, it becomes possible to generate the convolution extension signal from which the interval that the unique feature is present is removed.

In a case where, for example, it is supposed to set three stages for a damper stepping amount of the pedal 107 between a small amount and a large amount by setting that the operation state of the pedal which functions as, for example, the damper pedal and which is illustrated in FIG. 1 is detected as the operator operation information 1004 in FIG. 10, states as follows are assumed.

A case where the damper is stepped a little→a state where the damper and the string are brought into contact and non-contact states and hence the sound is distorted or has the unique feature.

A case where the damper is stepped many times→a state where the sound resonates well in a case where the damper is separated from the string.

A case where the damper is stepped moderately→a state between the above-mentioned two states.

The following setting is conceivable in a convolution table 1401 in FIG. 14 from the above states.

The case where the damper is stepped a little→the level value of the multiplier 309=100%, the level values of the multipliers 310 and 1002=0% and the level value of the multiplier 312=rather low.

The case where the damper is stepped many times→the level value of the multiplier 309=0%, the level values of the multipliers 310 and 1002=100% and the level value of the multiplier 312=rather high.

The case where the damper is stepped moderately→the level value of the multiplier 309=50%, the level values of the multipliers 310 and 1002=50% and the level value of the multiplier 312=middle.

As an alternative, the level values of the multipliers 310 and 1002 may be equally set or appropriately set depending on the number of blocks to be processed.

In addition, in a case where the respective stages exhibit continuous values, an interpolation process may be appropriately performed.

Thereby, it becomes possible to effectively add the resonance effect to the sound in accordance with the damper operation amount by the pedal 107.

According to the above-described embodiments, since the configuration is made such that the interval that the convolution execution unit 301 processes is made changeable and the output from the convolution execution unit 301 is selectively applied to the convolution extension unit 302, it becomes possible to select the input signal into the convolution extension unit 302.

Accordingly, it becomes possible to output the convolution extension signal in a natural form by forming so as not to input the impulse response data which has the unique feature on its leading part into the convolution extension unit 302.

In addition, in a case where the convolution arithmetic operation is executed by combining together the FIR filter arithmetic processing and the CONV arithmetic processing according to the embodiments of the present invention, it is possible to add the impulse response to the musical sound signal with no occurrence of a delay which corresponds to one block while flexibly changing the block size in accordance with sound emission setting, the system state and so forth and therefore it becomes possible to add the effect which is high in responsiveness and reproducibility to the sound in application of the effect addition device of the present invention to the electronic musical instrument and so forth.

According to the above-described embodiments, since the convolution execution unit 301 is divided not depending on such classification that one part is used for the early reflection and another part is used for rear reverberation, but depending on the classification which is based on the size of the block that the FIR filter arithmetic processing section 303 and the CONV arithmetic processing section 304 (the CONV1 arithmetic processing section 304 or the CONV2 arithmetic processing section 1001) processes, there is no need to perform delay adjustment for timing matching among the respective processing units and sections.

According to the above-described embodiments, it becomes possible to select one effect addition form which conforms to the target effect and processing load by changing the configuration.

What is claimed is:

1. An effect addition device comprising:

at least one processor, wherein the at least one processor executes:

a time domain convolution process of convolving a first time domain data part of impulse response data of sound effects with time domain data on an original sound by time domain FIR (Finite Impulse Response) arithmetic processing which is executed in units of sampling periods;

a frequency domain convolution process of convoluting a second time domain data part of the impulse response data with the time domain data on the original sound by frequency domain arithmetic processing using a fast Fourier transform arithmetic operation in units of blocks of a predetermined time length respectively;

a convolution extension process of extending a convolved state or states of an output signal or output signals which is/are output as a result of execution of either the time domain convolution process or the frequency domain convolution process or both of the time domain convolution process and the frequency domain convolution process at least by either one type of arithmetic processing which corresponds to an all-pass filter or arithmetic processing which corresponds to a comb filter or both types of the arithmetic processing in a time range which exceeds a time width of the impulse response data; and a synthesized sound effect addition process of adding a sound effect which is synthesized by execution of the time domain convolution process, the frequency domain convolution process, and the convolution extension process to the original sound, and wherein the at least one processor:

convolves a front-half time domain data part in the time width of the impulse response data with the time domain data on the original sound by the time domain FIR arithmetic processing which is executed in units of the sampling periods in the time domain convolution process, convolves a rear-half time domain data part in the time width of the impulse response data with the time domain data on the original sound by the frequency domain arithmetic processing using the fast Fourier transform arithmetic operation in units of blocks of the predetermined time length respectively in the frequency domain convolution process, and extends the convolved states of the output signals which are output as the result of execution of both of the time domain convolution process and the frequency domain convolution process at least by either the arithmetic processing which corresponds to the all-pass filter or the arithmetic processing which corresponds to the comb filter or both types of the arithmetic processing in the time range which exceeds the time width of the impulse response data in the convolution extension process.

2. The effect addition device according to claim 1, wherein the at least one processor changes a synthesis condition which is a combination of conditions under each of which each of the time domain convolution process, the frequency domain convolution process, and the convolution extension process contributes to the synthesized sound effect.

3. The effect addition device according to claim 2, wherein the at least one processor designates one synthesis condition which is selected from a plurality of synthesis conditions which are stored in a synthesis condition storage unit which stores in advance the synthesis conditions for every type of the sound effect and executes the synthesized sound effect addition process.

4. The effect addition device according to claim 2, wherein the synthesis condition includes a synthesis condition which is selectable before a music performance is started and a synthesis condition which is dynamically changeable in accordance with a user operation while the music performance is being conducted.

5. The effect addition device according to claim 1, wherein the at least one processor adds one sound effect which lasts up to a first delay time of the impulse response data by the time domain convolution process, adds another sound effect which lasts up to a second delay time of the impulse response data and which comes after at least the first delay time by the frequency domain convolution process, and adds still another sound effect which lasts up to a delay time for which the impulse response data is not present and which comes after at least the second delay time by the convolution extension process.

6. The effect addition device according to claim 5, wherein the synthesis condition is a condition that the first delay time and the second delay time are optionally designated.

7. The effect addition device according to claim 1, wherein the at least one processor executes a plurality of the frequency domain convolution processes and, in each of the plurality of frequency domain convolution processes, executes convolution arithmetic processing on one of respective time domain data portions which are obtained by further dividing the rear-half time domain data part of the impulse response data and on the original sound time domain data in units of blocks of predetermined time lengths which correspond to the plurality of the frequency domain convolution processes respectively by the frequency domain arithmetic processing using the fast Fourier transform arithmetic operation.

8. The effect addition device according to claim 1, wherein the at least one processor further executes a synthesis process of inputting a signal which is formed by synthesizing the output signal which is output as the result of execution of the time domain convolution process and the output signal which is output as the result of execution of the frequency domain convolution process as an input signal in the convolution extension process.

9. The effect addition device according to claim 8, wherein the at least one processor optionally changes weighting on the output signal which is output as the result of execution of the time domain convolution process and the output signal which is output as the result of execution of the frequency domain convolution process which are synthesized in the synthesis process.

10. The effect addition device according to claim 1, wherein the at least one processor controls an output signal which is output as a result of execution of the convolution extension process by envelopes of the output signal which is output as the result of execution of the time domain convolution process and the output signal which is output as the result of execution of the frequency domain convolution process.

11. The effect addition device according to claim 1, wherein the at least one processor changes the input signal or an output signal for the convolution extension process in accordance with operation information on an operator.

12. An effect addition method comprising:

a time domain convolution process of convolving a first time domain data part of impulse response data of sound effects with time domain data on an original sound by time domain FIR (Finite Impulse Response) arithmetic processing which is executed in units of sampling periods;

a frequency domain convolution process of convoluting a second time domain data part of the impulse response data with the time domain data on the original sound by frequency domain arithmetic processing using a fast Fourier transform arithmetic operation in units of blocks of a predetermined time length respectively;

a convolution extension process of extending a convolved state or states of an output signal or output signals which is/are output as a result of execution of either the time domain convolution process or the frequency domain convolution process or both of the time domain convolution process and the frequency domain convolution process at least by either one type of arithmetic processing which corresponds to an all-pass filter or arithmetic processing which corresponds to a comb filter or both types of the arithmetic processing in a time range which exceeds a time width of the impulse response data;

a synthesized sound effect addition process of adding a sound effect which is synthesized by execution of the time domain convolution process, the frequency domain convolution process and the convolution extension process to the original sound;

convolving a front-half time domain data part in the time width of the impulse response data with the time domain data on the original sound by the time domain FIR arithmetic processing which is executed in units of the sampling periods in the time domain convolution process;

convolving a rear-half time domain data part in the time width of the impulse response data with the time domain data on the original sound by the frequency domain arithmetic processing using the fast Fourier transform arithmetic operation in units of blocks of the predetermined time length respectively in the frequency domain convolution process; and extending the convolved states of the output signals which are output as the result of execution of both of the time domain convolution process and the frequency domain convolution process at least by either the arithmetic processing which corresponds to the all-pass filter or the arithmetic processing which corresponds to the comb filter or both types of the arithmetic processing in the time range which exceeds the time width of the impulse response data in the convolution extension process.

13. A non-transitory computer-readable medium storing a program which is executable by a processor of an effect addition device and controls the processor to execute:

a time domain convolution process of convolving a first time domain data part of impulse response data of sound effects with time domain data on an original sound by time domain FIR (Finite Impulse Response) arithmetic processing which is executed in units of sampling periods;

a frequency domain convolution process of convoluting a second time domain data part of the impulse response data with the time domain data on the original sound by frequency domain arithmetic processing using a fast Fourier transform arithmetic operation in units of blocks of a predetermined time length respectively;

a convolution extension process of extending a convolved state or states of an output signal or signals which is/are output as a result of execution of either the time domain convolution process or the frequency domain convolution process or both of the time domain convolution process and the frequency domain convolution process at least by either one type of arithmetic processing which corresponds to an all-pass filter or arithmetic processing which corresponds to a comb filter or both types of the arithmetic processing in a time range which exceeds a time width of the impulse response data; and a synthesized sound effect addition process of adding a sound effect which is synthesized by execution of the time domain convolution process, the frequency domain convolution process and the convolution extension process to the original sound, wherein the processor, under control of the program:

convolves a front-half time domain data part in the time width of the impulse response data with the time domain data on the original sound by the time domain FIR arithmetic processing which is executed in units of the sampling periods in the time domain convolution process, convolves a rear-half time domain data part in the time width of the impulse response data with the time domain data on the original sound by the frequency domain arithmetic processing using the fast Fourier transform arithmetic operation in units of blocks of the predetermined time length respectively in the frequency domain convolution process, and extends the convolved states of the output signals which are output as the result of execution of both of the time domain convolution process and the frequency domain convolution process at least by either the arithmetic processing which corresponds to the all-pass filter or the arithmetic processing which corresponds to the comb filter or both types of the arithmetic processing in the time range which exceeds the time width of the impulse response data in the convolution extension process.

14. An effect addition device comprising:

at least one processor, wherein the at least one processor executes:

a time domain convolution process of convolving a first time domain data part of impulse response data of sound effects with time domain data on an original sound by time domain FIR (Finite Impulse Response) arithmetic processing which is executed in units of sampling periods;

a frequency domain convolution process of convoluting a second time domain data part of the impulse response data with the time domain data on the original sound by frequency domain arithmetic processing using a fast Fourier transform arithmetic operation in units of blocks of a predetermined time length respectively;

a convolution extension process of extending a convolved state or states of an output signal or output signals which is/are output as a result of execution of either the time domain convolution process or the frequency domain convolution process or both of the time domain convolution process and the frequency domain convolution process at least by either one type of arithmetic processing which corresponds to an all-pass filter or arithmetic processing which corresponds to a comb filter or both types of the arithmetic processing in a time range which exceeds a time width of the impulse response data; and a synthesized sound effect addition process of adding a sound effect which is synthesized by execution of the time domain convolution process, the frequency domain convolution process, and the convolution extension process to the original sound, wherein the at least one processor changes a synthesis condition which is a combination of conditions under each of which each of the time domain convolution process, the frequency domain convolution process, and the convolution extension process contributes to the synthesized sound effect, and wherein the at least one processor designates one synthesis condition which is selected from a plurality of synthesis conditions which are stored in a synthesis condition storage unit which stores in advance the synthesis conditions for every type of the sound effect and executes the synthesized sound effect addition process.

* * * * *